US011790882B2

(12) United States Patent
Lu et al.

(10) Patent No.: US 11,790,882 B2
(45) Date of Patent: Oct. 17, 2023

(54) ACTIVE NOISE CANCELLATION FILTER ADAPTATION WITH EAR CAVITY FREQUENCY RESPONSE COMPENSATION

(71) Applicant: Shenzhen Goodix Technology Co., Ltd., Shenzhen (CN)

(72) Inventors: Youhong Lu, San Diego, CA (US); Lelin Wang, Shenzhen (CN); Guoliang Li, Shenzhen (CN); Ching-Hua Yeh, San Diego, CA (US)

(73) Assignee: SHENZHEN GOODIX TECHNOLOGY CO., LTD., Shenzhen (CN)

( * ) Notice: Subject to any disclaimer, the term of this patent is extended or adjusted under 35 U.S.C. 154(b) by 58 days.

(21) Appl. No.: 17/695,816

(22) Filed: Mar. 15, 2022

(65) Prior Publication Data

US 2023/0298558 A1 Sep. 21, 2023

(51) Int. Cl.
*G10K 11/178* (2006.01)
*H04R 1/10* (2006.01)

(52) U.S. Cl.
CPC .. *G10K 11/17854* (2018.01); *G10K 11/17823* (2018.01); *G10K 11/17825* (2018.01); *G10K 11/17881* (2018.01); *H04R 1/1083* (2013.01); *G10K 2210/1081* (2013.01); *G10K 2210/3026* (2013.01); *G10K 2210/3027* (2013.01); *G10K 2210/3044* (2013.01); *G10K 2210/3048* (2013.01); *H04R 2460/01* (2013.01)

(58) Field of Classification Search
CPC ..... G10K 11/17813; G10K 11/17815; G10K 11/17817; G10K 2210/3033; G10K 2210/3048; G10K 2210/3055
See application file for complete search history.

(56) References Cited

U.S. PATENT DOCUMENTS 8,693,699 B2 * 4/2014 Fellers ..... G10K 11/17885 381/71.1
2011/0158419 A1 * 6/2011 Theverapperuma ..... H04R 1/1083 381/71.1

FOREIGN PATENT DOCUMENTS

FR 2999772 A1 * 6/2014 ..... G10K 11/178

* cited by examiner

*Primary Examiner* — Kile O Blair
(74) *Attorney, Agent, or Firm* — KILPATRICK TOWNSEND & STOCKTON LLP

(57) ABSTRACT

Embodiments and methods perform ear cavity frequency response (EFCR) adaptive noise cancelation (ANC) with path-compensation over an entire main path to the eardrum (MPED) of a user. A number of ANC filter models are pre-trained to include respective anti-noise path (ANP) filter models and respective MPED filter models representing ANC filter configurations. As a user wears a headphone earpiece, characteristics of the wearer and the position/orientation of wearing manifest a wearer/wearing condition. Techniques described herein can continuously or periodically and efficiently determine which of the pre-trained ANC filter models most closely described the present MPED of the present wearer/wearing condition, and can continuously or periodically update the ANC filter configuration based on the pre-trained models to maintain high-performance ANC that includes EFCR path-compensation.

20 Claims, 8 Drawing Sheets

ACTIVE NOISE CANCELLATION FILTER ADAPTATION WITH EAR CAVITY FREQUENCY RESPONSE COMPENSATION

FIELD

Embodiments described herein are generally concerned with audio processing and noise cancellation, and, more particularly, on active noise cancellation filter adaptation with ear cavity frequency response compensation in headphone systems.

BACKGROUND

Many high-performance headphone systems include active noise cancellation (ANC). The purpose of ANC is to improve a wearer's listening experience by dynamically canceling ambient and/or other noise. Such canceling typically involves generating a synthesized noise through an audio transducer (for example, a loudspeaker located in that area or at that location) such that the generated signal, an "anti-noise" signal, ideally has the same magnitude and phase as that of the noise but with inverted polarity. Playing the anti-noise signal along with desired audio can effectively cancel out much of the noise.

For various reasons, such as a dynamically changing nature of the noise, the anti-noise signal typically will not be able to cancel all the noise. Conventionally, an error sensor (e.g., an error microphone) is placed in the audio output path to pick up the mix of the environmental noise and the generated synthesized anti-noise signal. The mix as picked up by the error sensor is an error signal, which can continually change over time. Conventionally, ANC algorithms are used in ANC filter designs to dynamically adapt to, and seek continually to minimize, noise experienced by the wearer. In some conventional ANC implementations, ANC filter settings are set in a laboratory and/or manufacturing setting to produce a fixed ANC, and the fixed ANC is incorporated into the headphone environment. In such cases, the headphones may not include an integrated error sensor, and the ANC filter settings may not be updated dynamically while the headphones are in use. In other conventional implementations, the headphones include an integrated error sensor, and ANC filter settings can be updated dynamically in real-time based on feedback of the error signal during use.

Many different types of approaches have been used with conventional ANC implementations to improve noise cancelation. For example, various techniques are used to shorten feedback paths, reduce processing delay, adapt to both wideband and narrowband types of noise, etc. However, even very high-performance ANC implementations tend not to account for error (e.g., noise) resulting from a wearer's physiology and/or the specific positioning of headphones relative to the wearer's physiology. For example, the shape of a user's inner ear, the distance to the user's eardrum, the relative positioning of the headphone output speakers to the user's ear structures, the effectiveness of an acoustic seal provided by the headphones, etc. can all impact the way in which a user hears the sound being produced by the headphones, including the user's experience of desired audio, as well as the mix of that desired audio with environmental noise and generated anti-noise signals. Conventional ANC approaches tend not to compensate for such physiological effects at all, and the rare conventional attempts to do so have generally been unsuccessful.

BRIEF SUMMARY OF THE INVENTION

Embodiments include systems and methods for active noise cancellation or control in a manner that compensates for an entire main noise path to a user's eardrum. For example, an ear cavity frequency response (EFCR) adaptive noise cancelation (ANC) system is integrated in a headphone earpiece and performs path-compensation over an entire main path to the eardrum (MPED). The system includes an ANC filter system to output an anti-noise signal at a target location (at an in-facing side of the headphone earpiece) based on a present ANC filter configuration so that the anti-noise signal as output at the target location is an estimate of an inverse of an in-ear noise signal. The in-ear noise signal corresponding to ambient noise as manifest at the target location due to acoustical path effects of the MPED while a user is wearing the headphone earpiece in a present wearer/wearing condition relative to an outer ear of the user. An error microphone records a residual noise signal representing a combination of the anti-noise signal and the in-ear noise signal in the present wearer/wearing condition. A model data memory can have, stored thereon, K (e.g., 50 or more) pre-trained ANC models, each kth pre-trained ANC model having a kth anti-noise path (ANP) filter model and a kth MPED filter model previously trained on a kth trained wearer/wearing condition.

A user adaptation engine can be coupled with the ANC filter system, the error microphone, and the model data memory. The user adaptation engine can be configured, for each kth pre-trained ANC model, to: compute a kth estimated actual noise signal by using the kth ANP filter model to transform the anti-noise signal into a path-compensated anti-noise signal, and removing the path-compensated anti-noise signal from the residual noise signal; compute a kth estimated eardrum noise signal by using the kth MPED filter model to transform the reference noise signal; and compute a kth candidate residual noise between the kth estimated actual noise signal and the kth estimated eardrum noise signal. The user adaptation engine can then select one of the pre-trained ANC models as yielding the lowest kth candidate residual noise and can direct the ANC filter system to replace the present ANC filter configuration with a new ANC filter configuration based on the selected one of the pre-trained ANC models.

BRIEF DESCRIPTION OF THE DRAWINGS

The benefits and advantages of the invention concept will be apparent from the detailed description of embodiments of the present disclosure and the accompanying drawings in which like reference characters and numerals refer to the same parts throughout the figures. The drawings are not to scale; emphasis is placed upon illustrating the principles of the inventive concept.

DETAILED DESCRIPTION OF THE INVENTION

Figure 1:
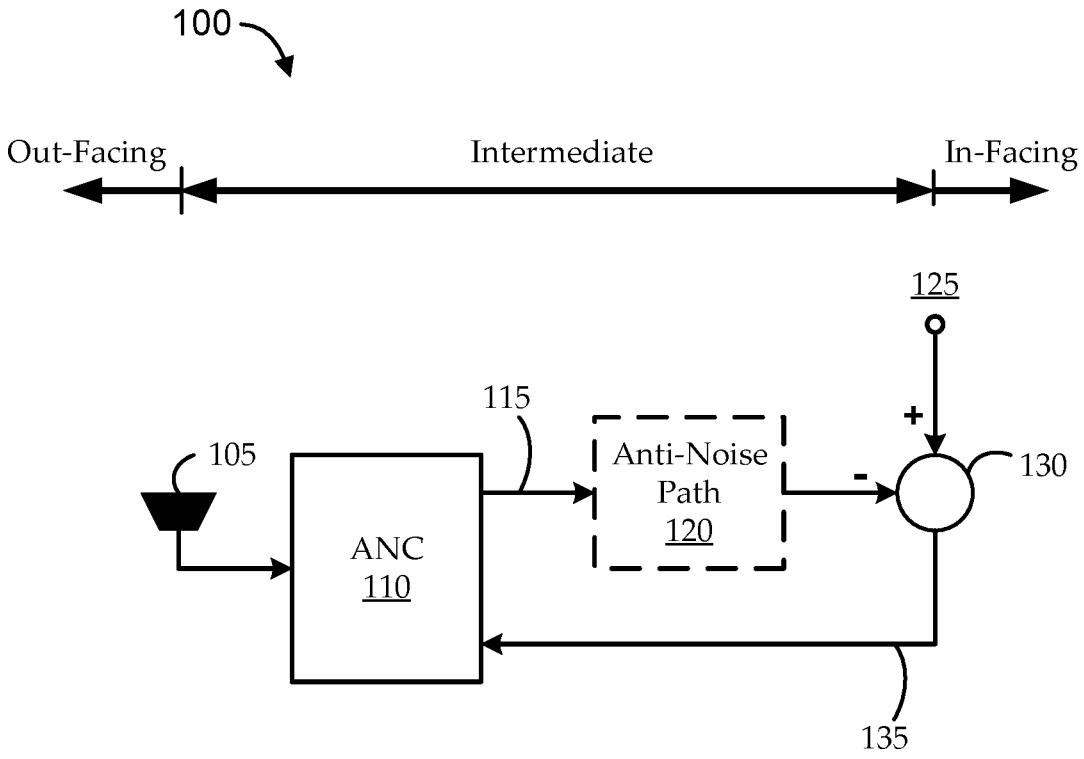
FIG. 1 (Prior Art)
FIG. 1 shows a simplified diagram of a headphone environment that includes a conventional active noise cancellation (ANC) system.

Embodiments described herein provide active noise cancellation filter adaptation with dynamic ear cavity frequency response compensation in headphone systems. As used herein, "headphones," "headphone systems," or the like can generally refer to any type of wearable speaker system for which the speakers are positioned directly over and/or in one or both of a user's ears. For example, embodiments described herein can be used in context of closed-back headphones, open-back headphones, on-ear headphones, over-ear headphones, in-ear headphones, earbuds, and/or any other suitable type of headphones, whether wired or wireless. In general, a user desires to listen to "desired audio," such as music, a voice recording, etc. At the same time, various factors can diminish the user's experience of that desired audio. As such, many high-performance headphone systems include active noise cancellation (ANC) system.

One set of factors that can frustrate the ability of headphones to deliver desired audio to a user in an optimal manner is the presence of ambient noise. The term ambient noise is used herein to generally include any environmental noises and/or any other audio that can be heard by the user but is not part of the desired audio. For example, if the user is trying to listen to audio in a noisy environment, the user may not be able to hear the audio well, and/or the ambient sounds may otherwise interfere with the listening experience. Another set of factors that can frustrate the ability of headphones to deliver desired audio to a user in an optimal manner is the specific relationship between the headphones and the ear physiology of the user. For example, whether an earpiece of a headphone system is in, over, or around a user's ear, the combined environment of the earpiece, the ear cavity, the eardrum, and other related structures manifest a particular acoustical environment with a particular frequency response. The acoustical environment and corresponding frequency response can be different for each user's ear, and for different placements of the earpiece relative to the ear.

As used herein, the term "wearer" is used to refer to an individual wearing headphones, whether on one or both ears, over one or both ears, in one or both ears, etc. It is assumed herein that, while playing audio (e.g., music, voice, etc.) through headphones, the wearer hears a combination of the played audio and ambient noise (i.e., assuming there is no ANC). The anatomy of a wearer's ear can be divided into an outer ear, a middle ear, and an inner ear. The outer ear (auricle) is a structure primarily formed of cartilage that effectively collects acoustical waves and channels them via an ear cavity (acoustic meatus) toward the eardrum (tympanic membrane). Shapes, sizes, and other characteristics of anatomical structures of the outer ear (e.g., the helix, antihelix, tragus, antitragus, meatus, cerumen, etc.) can define a frequency response of the outer ear until the eardrum. For the sake of simplicity, it is assumed herein that the wearer "hears" based primarily on the manner in which desired and undesired audio information (acoustical waves) entering the outer ear ultimately reach and interact with the eardrum. For example, this includes impacts of the outer ear anatomy and physiology on that audio information, but not anatomical or physiological impacts of the middle ear or inner ear structures.

When an individual is wearing headphones, each earpiece of the headphones (or a single earpiece in some cases) are placed in a wearing position relative to the wearer's ear anatomy. It can generally be assumed that the wearing position defines an out-facing environment and an in-facing environment, and there may be an intermediate environment between the out-facing environment and the in-facing environment (e.g., in the space consumed by the headphones). The headphones intend to project desired audio (e.g., and anti-noise signals in the case of ANC) into the in-facing environment using a primary earpiece speaker, and to block out and/or cancel ambient noise from the out-facing environment. In a typical ANC implementation, this can involve recording ambient noise from the out-facing environment, generating an anti-noise signal based on the recorded ambient noise and a model of the intermediate environment, and projecting the anti-noise signal into the in-facing environment (e.g., using a secondary anti-noise speaker) along with the desired audio.

FIG. 1 shows a simplified diagram of a headphone environment 100 that includes a conventional active noise cancellation (ANC) system 110. For example, the ANC system 110 can be integrated into a headphone system, such as into a headphone earpiece. As described above, placement of each earpiece in the wearer's ear can effectively define an out-facing environment, an in-facing environment, and an intermediate environment. For example, a reference microphone records ambient noise at the out-facing boundary of the intermediate environment, the ANC system 110 generates an anti-noise signal 115 (a synthesized noise signal) based at least on the ambient noise, and the headphones output the anti-noise signal 115 at the in-facing boundary of the intermediate environment (a target location). The target location is typically in close proximity to the location of the main earpiece speaker (and/or an error microphone), from which desired audio is being output by the earpiece.

Conventionally, the purpose of outputting the anti-noise signal 115 at the target location is to at least partially cancel whatever version of the ambient noise (illustrated as in-ear noise signal 125) is present at the same target location. For example, some portion of ambient noise from outside the ear reaches the target location as an in-ear noise signal 125 by traversing the intermediate environment over a "main noise path." A small speaker located substantially at the target location outputs the anti-noise signal 115, so that the target location now includes a combination (e.g., a superposition) of the anti-noise signal 115 and the in-ear noise signal 125 (in addition to any desired audio). Conventionally, it is considered that maximum noise cancelation occurs when the anti-noise signal 115 is identical to an inversion of the in-ear noise signal 125. For example, the combination of the anti-noise signal 115 and the in-ear noise signal 125 yields a residual noise signal 135, which is essentially an error signal for the noise cancelation. Some conventional implementations include an error microphone (also located in the target location) that records the residual noise signal 135 and feeds the residual noise signal 135 back to the ANC system 110 for dynamic adaptation.

As noted above, ambient noise is considered as traveling from the out-facing environment to the target location via a main noise path, otherwise referred to simply as a main path. The main path is effectively an aggregate of the physical paths by which ambient noise can reach the target location, such that the main path also has a particular main path frequency response impacted by the physical structures of the headphones and some anatomical structures of the outer ear. As illustrated, conventional ANC systems 110 can account for an anti-noise path 120, also referred to as a secondary noise path, or more simply as a secondary path. The anti-noise path 120 can be the path (or a modeled representation of the path) between the location where the anti-noise signal 115 is generated and the location where the anti-noise signal 115 is output. For example, it can be mathematically assumed that the reference noise signal 105 and the feedback residual noise signal 135 are both received at a point in space that is some distance from a point in space coincident with the target location. That distance can add delay to and/or other artifacts to the anti-noise signal 115. Because headphones with ANC features typically receive reference noise by an out-facing component of each earpiece and output a generated anti-noise signal 115 at an in-facing component of each earpiece, conventional ANC designs typically assume the main path to be substantially equivalent to the intermediate environment, as illustrated. As such, conventional ANC systems 110 tend to use the anti-noise path 120 as a representation of the main path, so that compensating for the anti-noise path 120 is treated as compensation for main path effects.

In general, the ANC system 110 seeks to generate the anti-noise signal 115 so that the anti-noise signal 115, as output at the target location after traversing the anti-noise path 120, combines with any ambient noise at the target location to minimize residual noise at the target location. For example, the ANC system 110 includes one or more filters with filter parameters that are adjustable based on the reference noise signal 105 and/or feedback of the residual noise signal 135 to generate the anti-noise signal 115. Dynamic control of the filter parameters seeks to generate the anti-noise signal 115, so that the corresponding anti-noise signal 115 traversing the anti-noise path 120 will combine with (i.e., destructively interfere with) the in-ear noise signal 125 to minimize the residual noise signal 135. Because ambient noise typically varies with time, any delay in generating the anti-noise signal and transmitting it over the anti-noise path 120 causes a mismatch between the generated anti-noise signal 115 and the noise it is trying to cancel (represented by in-ear noise signal 125). As such, it is desirable for the anti-noise path 120 to have as little delay as practical.

Conventionally, there tend to be at least three approaches to synthesizing an anti-noise signal 115 by an ANC system. One type of approach synthesizes noise by capturing reference noise using a reference sensor. The reference noise can be an earlier version of the noise with additional reflections of the noise via multi-paths. The synthesis of the noise can be done by applying an adaptive filter or a controller to the reference noise such that the error (difference) between the noise and the played synthesized noise is minimized. The noise synthesis must be done quickly so that it adds little delay and the synthesized noise can arrive to the target location nearly in synch with the noise being canceled. Such ANC approaches are referred to as "feedforward" ANC. Since there is a reference sensor to sense the earlier version of the noise, feedforward ANC can cancel relatively wideband noise. Therefore, such a feedforward-based ANC approach is referred to herein as a wideband (WB) ANC.

A second type of approach to synthesizing an anti-noise signal by an ANC system seeks to cancel narrowband (NB) noise (for ANC purposes, typical noise is from 20 Hz up to 1000 Hz), or noise components including several tonal signals, by predicting the synthesized noise. For example, implementations of the ANC system can use an error signal from an error sensor (e.g., an error microphone) to estimate the noise and can predict the noise after it passes through the secondary path from the estimation. Such ANC approaches are referred to as "feedback" ANC. With a pure feedback ANC approach, a reference sensor may not be needed. The prediction performance can be higher with lower waterbed effect (undesired noise with a relatively narrow frequency band) if the secondary path and processing have low latency. Thus, for certain bandwidths, the feedback ANC has better performance with lower latency. If a signal is not narrowband, the narrowband requirement can be achieved by emphasizing some frequency bands where noise reduction is desired. Such a feedback-based ANC approach is referred to herein as a narrowband (NB) ANC.

A third type of approach to synthesizing an anti-noise signal by an ANC system seeks to cancel both wideband (WB) and narrowband (NB) noises. Such approaches effectively combine a WB ANC implementation and a NB ANC implementation into a mixed ANC, which is referred to herein as a "hybrid" ANC. The conventional ANC system 110 of FIG. 1 can be considered as a simplified illustration of a hybrid ANC approach, as it includes both a feedforward type of reference noise signal 105 and a feedback type of residual noise signal 135. In a WB ANC path of the hybrid approach, a reference microphone can be used to detect the reference noise signal 105, corresponding to ambient noise in the out-facing environment. The reference microphone can pass the detected reference noise signal 105 to the ANC system 110, which generates the anti-noise signal 115. The anti-noise signal 115 is output to the target location via the anti-noise path 120 (e.g., while concurrently outputting desired audio at substantially the same target location). Ideally, the anti-noise signal 115 completely cancels any ambient noise in the target location, as represented by the in-ear noise signal 125. However, practically, there will be some cancelation error, so that the sum of the anti-noise signal 115 at the target location and the in-ear noise signal 125 at the target location (represented by summer 130) yields residual noise, represented by the residual noise signal 135. In a NB ANC path of the hybrid approach, the residual noise signal 135 is fed back to the ANC system 110 for dynamic feedback control of the ANC filter parameters. Though not explicitly shown, feedback of the residual noise signal 135 can be accomplished by placing an error sensor in or near the target location to detect the residual noise signal 135. For example, one or more error microphones can be integrated with the headphone system (e.g., at an in-facing location on one or both earpieces) to record noise at or near the target location.

Figure 2:
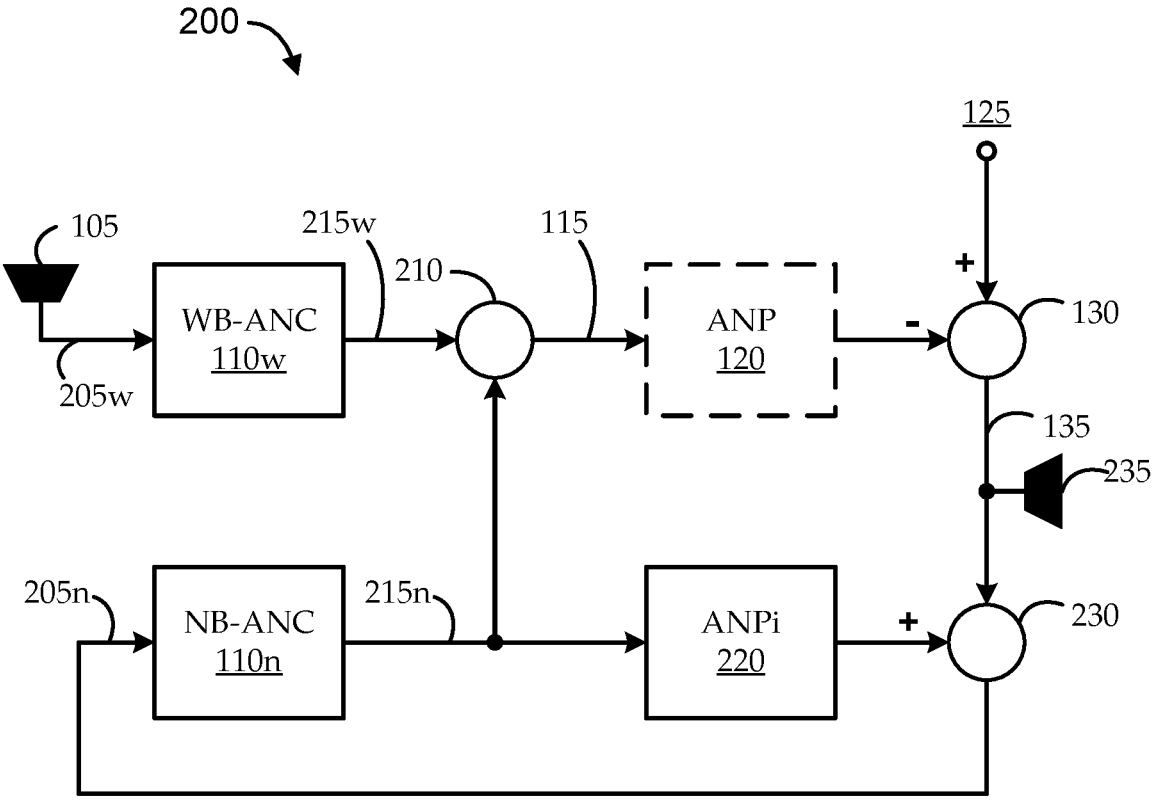
FIG. 2 (Prior Art)
FIG. 2 shows another simplified diagram of a conventional headphone environment that includes a conventional hybrid-type of active noise cancellation (ANC) system that is more explicitly represented as a separate wideband (WB) ANC subsystem and narrowband (NB) ANC subsystem.

FIG. 2 shows another simplified diagram of a conventional headphone environment 200 that includes a conventional hybrid-type of active noise cancellation (ANC) system 110 that is more explicitly represented as a separate wideband (WB) ANC subsystem 110*w* and narrowband (NB) ANC subsystem 110*n*. For convenient reference, similar components and signals to those of FIG. 1 are labeled with the same reference designators. As illustrated, each ANC subsystem receives its own input signal from which to generate its own anti-noise contribution 215 to the anti-noise signal 115. In particular, as described above, the WB-ANC subsystem 110*w* generates its anti-noise contribution 215*w* based on receiving a reference noise signal 205*w* from the reference microphone 105, and the NB-ANC subsystem 110*n* generates its anti-noise contribution 215*n* based on receiving a feedback signal 205*n* relating to the residual noise signal 135.

The WB anti-noise contribution 215*w* and the NB anti-noise contribution 215*n* combine at summing node 210 to produce the anti-noise signal 115. As in FIG. 1, the anti-noise signal 115 is transmitted to the target location via an anti-noise path 120 (ANP) 120, which corresponds to anti-noise path 120 of FIG. 1. At the target location, the anti-noise signal 115 destructively interferes with a local version of ambient noise at the target location (in-ear noise signal 125) to produce a residual noise signal 135. For example, a summer 130 represents the interference at the target location between the in-ear noise signal 125 and the anti-noise signal 115 resulting in a residual noise signal 135 (i.e., representing noise-cancelation error). As illustrated, embodiments can include an error microphone 235 to record the residual noise signal 135.

In the illustrated implementation, rather than feeding back the residual noise signal 135 directly to the NB-ANC 110*n*, the feedback is adjusted to compensate for an impulse response of the anti-noise path 120. As illustrated, an ANPi filter 220 is configured to match the frequency response (impulse response) of the anti-noise path 120. The NB anti-noise contribution 215*n* can be passed through the ANPi filter 220 and added to the residual noise signal 135 at a feedback compensation node 230, and the output of the feedback compensation node 230 can be fed back as the feedback signal 205*n* input to the NB-ANC subsystem 110*n*. In some other cases, the residual noise may directly be used as NB ANC reference.

Mathematically, the residual noise signal 135 ("e") can be described as: e=n−SP*y, where "n" is the target location noise signal 125, "y" is the anti-noise signal 115, and "SP" is a representation of the response of the anti-noise path 120. The in-ear noise signal 125 is unknown, but it can be estimated as: n=e+SPi*y, where "SPi" is the pre-computed impulse response of SP, as implemented by the ANPi filter 220. In some implementations, the reference input 205*w* to the WB-ANC subsystem 110*w* is the reference microphone signal 105. In other implementations, the reference input 205*w* to the WB-ANC subsystem 110*w* can correspond to an earlier version of reference noise, such as with additional reflections of the noise via one or more paths. In such implementations, the reference input 205*w* ("x") can be described as: x=SPi*xw, where "xw" is the reference microphone signal 105. The output of the WB-ANC subsystem 110*w* can be described as: yw=WB*x, where "yw" is the WB anti-noise contribution 215*w* resulting from application of the WB-ANC subsystem 110*w* filter, as represented by "WB." The residual noise after applying filtering from the WB-ANC subsystem 110*w* can therefore be described as: ew=n−yw; and filter coefficients of the WB-ANC subsystem 110*w* can be updated according to: WB=WB+mu*ew*x, where "mu" is an adaptation coefficient and can be a variable depending on what the adaptive filtering algorithm is used.

The filter coefficients of the NB-ANC subsystem 110*n* can also be adaptively updated according to the same, or any other suitable adaptation algorithm. It can be seen that the feedback reference input 205*n* to the NB-ANC subsystem 110*n* corresponds to the residual noise filtering by the WB-ANC subsystem 110*w* and after traversing the anti-noise path 120 (with a response modeled as SPi). As such, feedback reference signal 205*n* can be described as: xn=SPi*ew. The output of the NB-ANC subsystem 110*n* can be described as: yn=NB*xn, where "yn" is the NB anti-noise contribution 215*n* resulting from application of the NB-ANC subsystem 110*n* filter, as represented by "NB." The residual noise after applying filtering from both the WB-ANC subsystem 110*w* and the NB-ANC subsystem 110*n* can therefore be described as: ee=ew−yn; and filter coefficients of the NB-ANC subsystem 110*n* can be updated according to: NB=NB+mu*ee*xn.

In general, the WB-ANC subsystem 110*w* implements a filter for which the reference microphone 105 provides the adaptive filter reference (i.e., input signal 205*w*), and the filter parameters dynamically adapt to minimize residual noise at the target location (e.g., as detected by error microphone 235) without the NB-ANC subsystem 110*n* effects. The NB-ANC subsystem 110*n* implements a filter for which path-compensated feedback from the target location provides the adaptive filter reference (i.e., input signal 205*n*), and the filter parameters dynamically adapt to minimize residual noise at the target location (e.g., as detected by error microphone 235) after the WB-ANC subsystem 110*w* effects. Each of the WB-ANC subsystem 110*w* and the NB-ANC subsystem 110*n* can be optimized in different ways. For example, some approaches optimize each of the WB-ANC subsystem 110*w* and the NB-ANC subsystem 110*n* independently, in series or in parallel. Other approaches optimize the NB-ANC subsystem 110*n* and the WB-ANC subsystem 110*w* jointly.

Various ANC designs can be implemented with analog and/or digital circuitry. In some designs, such as for light-weight devices, active resistor and capacitor (RC) circuits can be effective for analog ANC designs. However, it can be difficult to change the RC circuit parameters in real-time to adapt to varying environments. In addition, the device acoustics may be different from one device to another device even if they are of the same type given variations between RC components. This can involve using different component values in different RC circuits for each device, which can involve considerable design effort and can be impractical or even insurmountable in mass production. Digital designs can be more flexible than analog designs because processing with modern algorithms can be realized easily with a digital component, such as a digital signal processor (DSP), or the like. As such, many high-performance ANC designs tend to be implemented primarily or exclusively with digital circuits. Filtered least mean squares (LMS) algorithms with finite impulse response (FIR) filters are widely used.

The conventional hybrid ANC designs discussed with reference to FIGS. 1 and 2 represent only some of many different types of hybrid ANC design architectures. As noted above, hybrid ANC approaches generally use a feedback filter to predict the noise for canceling low-frequency and/or tonal-like noise, and use a feedforward filter to synthesize anti-noise from a reference noise for canceling broadband or wideband noise. Both analog and digital circuits can be used. Digital circuits with advanced algorithms have been successfully used for many ANC designs over the years, but noise cancellation performance can tend to be limited due at least to high latency in the playback synthesized noise path (i.e., the anti-noise path, or secondary path). More recently, fast digital processing circuits have been used to adapt filter coefficients in near-real-time. While this has improved performance, ANC designs have continued to have limited ability to fully utilize complex algorithms because of the high computational cost and power consumption associated with running such algorithms in real time. A number of improved hybrid ANC designs are described in U.S. Pat. No. 11,189,261, titled "Hybrid Active Noise Control System," filed May 31, 2020, which is hereby incorporated by reference in its entirety.

While many different ANC designs are known, conventional ANC designs do not tend to account for acoustical effects of the region of the outer ear between the conventional target location and the wearer's eardrum. As described above, headphones that include ANC features can typically include in-facing components, such as a speaker to output at least the synthesized anti-noise signal 115 at the target location, and a microphone to detect the residual noise signal 135 at the target location. When an individual wears such headphones, each individual headphone (i.e., a right-ear headphone and a left-ear headphone) is placed on or partially in a respective ear, thereby positioning the in-facing components at a certain location in the outer ear of the wearer. Because the location of the in-facing components in each ear is removed from the eardrum of that ear (headphones are not designed to contact the eardrum), an additional acoustic environment is formed between the target location and the eardrum in each ear. Each such acoustic environment has its own frequency response that depends on a number of factors, including "wearer" factors and "wearing" factors. Wearer factors can include, for example, anatomical structures of the corresponding region of the outer ear and physiological performance of those outer ear structures. Wearing factors can include, for example, the position and orientation of the headphones in the outer ear, acoustical sealing between the out-facing and in-facing environments due to the interposing headphone, acoustical properties of the headphone itself, etc. As used herein, when a headphone is placed into an ear by a wearer, it is said to be in a particular "wearer/wearing condition," which corresponds to a set of both wearer and wearing factors. Thus, any wearer/wearing condition will manifest a characteristic frequency response, referred to herein as an "ear cavity frequency response," or ECFR. While conventional ANC implementations seek to minimize effects of ambient noise at that the target location (where the in-facing components of the headphones are positioned in the wearer's outer ears), conventional implementations do not tend to consider ECFR in noise cancelation.

Embodiments described herein provide novel approaches to dynamically adapting ANC features to optimize audio delivery with ambient noise cancelation with ECFR compensation. For example, physical in-ear sensor hardware can be used in a test environment to pre-train hybrid ANC filter parameters for a large number of ECFR models. Each pre-trained ECFR model can be associated with an identifier. During use, a user adaptation engine can use hybrid ANC filters to continually and adaptively cancel ambient noise while also continually iterating through the pre-trained ECFR models to dynamically determine which combination of ANC filter parameters minimizes residual noise in the ear cavity. Some embodiments can further adjust filter parameters away from the pre-trained ECFR model settings for additional optimization. In some such embodiments, those further optimized parameters can be stored as additional ECFR models.

Figure 3:
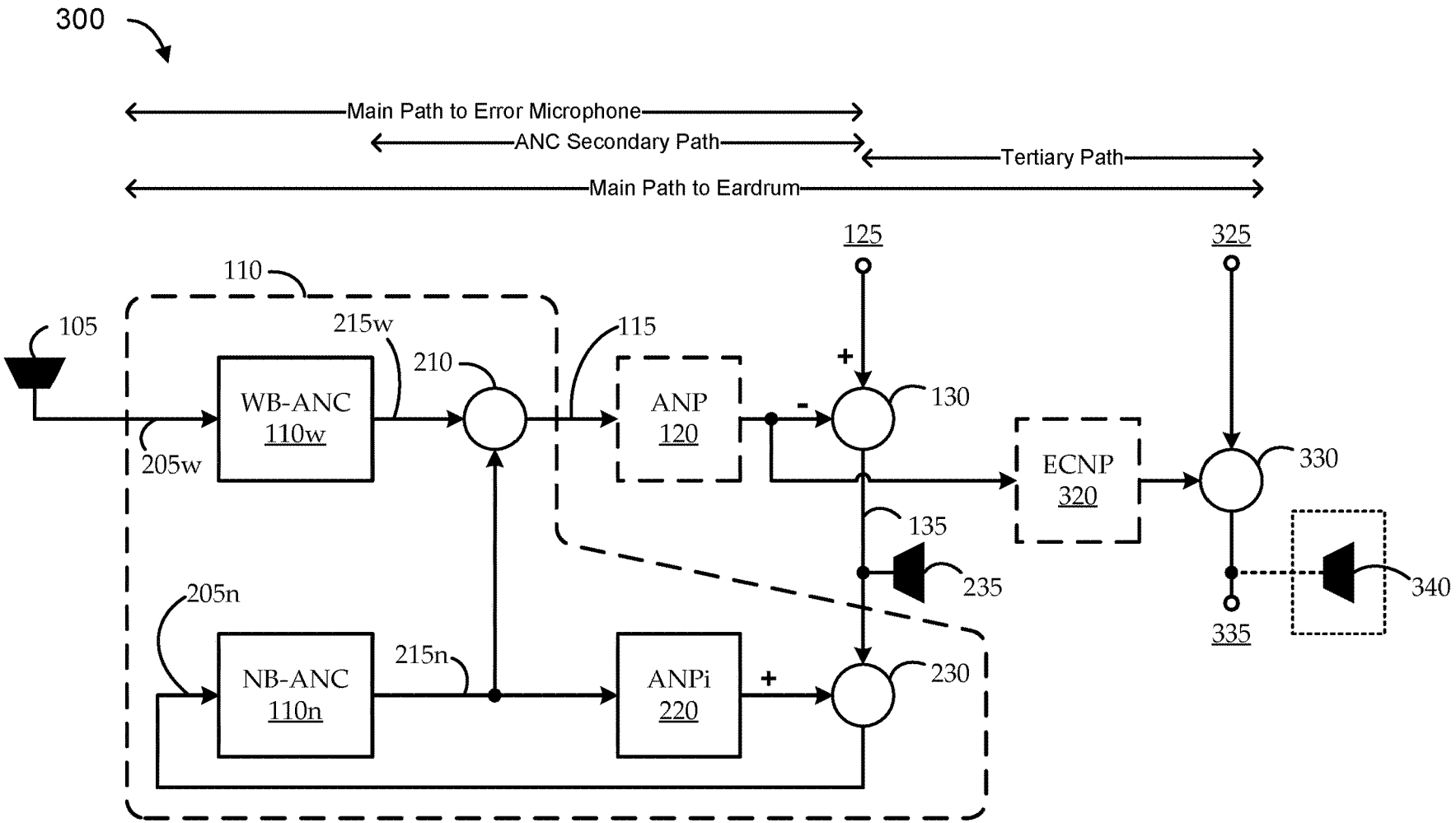
FIG. 3 shows a simplified block diagram of an illustrative ANC architecture for hybrid ambient noise cancelation with ear cavity frequency response (ECFR) compensation, according to various embodiments described herein.

FIG. 3 shows a simplified block diagram of an illustrative ANC architecture 300 for hybrid ambient noise cancelation with ear cavity frequency response (ECFR) compensation, according to various embodiments described herein. The illustrative ANC architecture 300 includes an ANC 110. For added clarity, details of the ANC 110 are shown substantially as the hybrid ANC implementation of FIG. 2, including a WB-ANC subsystem 110*w* and a NB-ANC subsystem 110*n*. It will be appreciated that, while some novel features are described herein in context of the particular illustrated hybrid ANC implementation, those same features can be applied to any suitable ANC design, including ANC designs having only a WB-ANC subsystem 110*w*, only a NB-ANC subsystem 110*n*, etc.

As described above, conventional ANC architectures seek to minimize ambient noise at a target location corresponding to a location of an error microphone 235 of the earpiece. The conventional target location is typically also the location of, or very close to the location of, the main earpiece speaker from which desired audio is output. For example, conventional ANCs tend to use one or more reference signals (e.g., reference noise signal 205*w* and/or feedback signal 205*n*) to generate an anti-noise signal 115, which is output at approximately the same location as error microphone 235 via an anti-noise path 120 that corresponds to an ANC secondary path. Ambient noise reaches approximately the same location via a conventional main path, which can be considered as approximately the main path to the error microphone (MPEM). The MPEM has a particular frequency response that causes ambient noise to manifest at the conventional target location as in-ear noise signal 125. Desired interference between the anti-noise signal 115 and the in-ear noise signal 125 results in a residual noise signal 135 corresponding to noise cancelation error at the conventional target location.

As illustrated, the listening environment can be considered as including an additional "tertiary" path between the conventional target location at the end of the MPEM and a wearer's eardrum. For example, the tertiary path includes at least the ear cavity. In a simplistic representation, individuals "hear" acoustic signals as they interact with the eardrum, not as they exist within other portions of the outer ear (of course, a more complete representation includes audio transmission through bone conduction and/or other mechanisms, which are essentially ignored herein). As such, any ambient noise at the conventional target location (as represented by the in-ear noise signal 125) is not the same as the ambient noise as experienced at the eardrum (at the end of the tertiary path). The manifestation of ambient noise at the eardrum is represented as eardrum noise signal 325. The eardrum noise signal 325 is essentially the result of the ambient noise traversing an entire main path to the eardrum (MPED), which includes the MPEM and the tertiary path. In practice, any ambient noise detected at the conventional target location is also influenced by the tertiary path, as the ambient noise reflects back to the conventional target location from around the ear cavity, and other tertiary path structures.

Conventional ANC implementations seek to minimize the residual noise signal 135 without accounting for the entire MPED. For example, conventional ANC filters can be initially trained (e.g., in a laboratory environment, or the like) based on detecting the residual noise signal 135 by an error microphone 235 and feeding back the residual noise signal 135 for use in updating ANC filter components to optimize synthesis of the anti-noise signal 115. However, such conventional training is based only on optimizing anti-noise signal 115 synthesis to the anti-noise path 120 and the MPEM, which ignores the tertiary path effects of any wearer/wearing condition. As described above, when an individual wears an earpiece of headphones, specific characteristics of the wearer (ear anatomy and physiology) and the wearing position combine to form a particular wearer/ wearing condition. For example, each individual can have a different ear shape, different ear cavity geometry, etc. Further, even small changes in the position and/or orientation of an earpiece in a wearer's ear will tend to change multiple characteristics of the MPED. For example, the earpiece shifting to a looser wearing position in the ear can result in a change in sealing and/or earpiece orientation, a change in position of the error microphone 235 relative to the eardrum, slight changes in the shapes of anatomical structures of the ear, and/or other factors, which can impact the frequency response of both the MPEM and the tertiary path. As such, each wearer/wearing condition can have different associated frequency response characteristics.

When a wearer wears a headphone device equipped with an ANC 110, it is desirable for the ANC 110 to adaptively choose ANC parameters and filters to achieve optimal noise-canceling performance for the particular wearer/wearing condition. It is further desirable to ensure that the adaptation time is very short (e.g., within a few seconds) for the user to feel that the noise-canceling performance is smooth and comfortable. It is desirable for the ANC 110 to adapt its filter parameters optimally in very short time, such as within a few seconds. This can involve designing parameters of ANC filters to quickly adapt the entire main path, which includes the entire MPED in novel embodiments herein. Further, during wearing and use of headphones (i.e., over time), the wearing position can change, which can change the overall acoustic path and the corresponding frequency response of the MPED. For example, an earpiece can become more tightly or more loosely situated in the user's ear, a user can switch earbud tips, or the like.

Novel embodiments described herein assume a training phase and an operating phase. The training phase occurs in a laboratory and/or other controlled environment prior to release for consumer use, and the operating phase occurs when headphones including features described herein are being worn by an end consumer. During the training phase, a training version of the earpiece is implemented with at least two microphones (or one or more microphones at each of three locations): the error microphone 235 and an eardrum microphone 340. In some cases, the training also includes the reference microphone 105. The eardrum microphone 340 is one or more physical microphones, or other audio sensors, placed at the eardrum. As used herein, phrases, like "at the eardrum" are intended to mean in a location in contact with, or as close to the eardrum as practical or useful, depending on the type of acoustical sensor being used. The training version of the earpiece is worn by multiple individuals in one or more ways to obtain data representing a number of different wearer/wearing conditions. For example, each of multiple wearers can wear one or more earpieces in one or more ways (e.g., inserted more or less tightly, with different earpiece tips, oriented in slightly different ways, etc.). Wearers with very similar MPED will generate one candidate in order to reduce frequently ANC filters switching.

The following descriptions assume that three microphones are used. Each wearer/wearing condition, acoustical information is collected from the three microphones. For example, a reference ambient noise signal is recorded by all three microphones without any ANC features being active (e.g., the training version of the earpiece may not even include the same ANC features as the production version, in some cases). Thus, the reference microphone 105 receives the "raw" ambient noise signal (or a reference noise signal is input directly without use of the reference microphone 105), the error microphone 235 receives a first version of the ambient noise as impacted by the MPEM, and the eardrum microphone 340 receives a second version of the ambient noise as impacted by the MPED. Differences between the versions of the same ambient signal can be used to model (e.g., compute transfer functions representing) the acoustic path effects of the MPEM and the MPED, which can further be used to isolate acoustic path effects of the tertiary path. Based on at least the computed models, filters can be designed (e.g., filter coefficients can be set) to represent a respective MPEM (which can substantially correspond to, or can be used to derive, a respective anti-noise path 120) and a respective MPED for each wearer/wearing condition. For example, the training phase results in K pre-trained ANC models 425, each having a respective one of K pre-trained ANP models, and a respective one of K pre-trained MPED models. K can be any suitable integer number, such as 50.

In the operational phase, a consumer version of the earpiece is being worn by a consumer (in a particular wearer/wearing condition), and ANC features are operational. A first manifestation of ambient noise (in-ear noise signal 125) and a first manifestation of the synthesized anti-noise signal 115 are both present at the conventional target location, which combine (e.g., modeled as summing node 130) to produce the residual noise signal 135. The in-ear noise signal 125 is essentially the ambient noise as it has traversed the MPEM, and the manifestation of the anti-noise signal 115 is essentially the anti-noise signal 115 as it has traversed the anti-noise path 120. At the same time, at the eardrum, there is both a second manifestation of the ambient noise (eardrum noise signal 325) and a second manifestation of the synthesized anti-noise signal 115, which combine (e.g., modeled as summing node 330) to produce an eardrum residual signal 335. The eardrum noise signal 325 is essentially the ambient noise as it has traversed the MPED (i.e., the MPEM plus the tertiary path), and the second manifestation of the anti-noise signal 115 is essentially the anti-noise signal 115 as it has traversed the anti-noise path 120 and an ear cavity noise path (ECNP) 320. As noted above, in any wearer/wearing condition, the error microphone 235 is actually located within the outer ear of the wearer, substantially at the start if the ECNP 320 (the end of the ECNP 320 being the eardrum). As such, when the anti-noise signal 115 and the in-ear noise signal 125 combine at the conventional target location (while the earpiece is being worn by a wearer), the resulting residual noise signal 135 traverses and interacts with the ECNP 320, such that the signal picked up by the error microphone 235 is actually the residual noise signal 135 as impacted by the ECNP 320. However, conventional ANC implementations are not pre-trained to differentiate between MPEM effects and MPED effects, which can frustrate the ability of conventional ANC implementations to optimally cancel noise for different wearer/wearing conditions.

If there is good acoustic sealing provided by the earpiece, the tertiary path (TYSP) and the ECNP 320 should be substantially identical in frequency response. As such, in a particular wearer/wearing condition, it can generally be assumed that differences between the eardrum residual signal 335 and the residual noise signal 135 are based on the same acoustical path effects as differences between the eardrum noise signal 325 and the in-ear noise signal 125. For example, suppose an earpiece is presently being worn (i.e., in operational phase) in a particular wearer/wearing condition, and that wearer/wearing condition is identical to a kth wearer/wearing condition that was pre-trained in the training phase. In that kth wearer/wearing condition, any difference between the present residual noise signal 135 as measured by the error microphone 235 and the present eardrum residual signal 335 (which cannot be measured directly in the operational phase configuration) should be precisely described by the kth pre-trained ANC model 425*k*.

For example, as described with reference to FIG. 2, in-ear noise signal 125 can be estimated as: n=e+SPi*y, where "SPi" is the pre-computed impulse response of SP, as implemented by the ANPi filter 220. As such, the eardrum noise signal 325 (ned) can be represented as: ned=ECNP*n, where "ECNP" is a mathematical representation of the ECNP 320. Also as described with reference to FIG. 2, the reference input 205*w* ("x") can be described as: x=SPi*xw, where "xw" is the reference noise signal 205*w* received by the reference microphone 105. As such, the WB-ANC subsystem 110*w* adaptive filtering algorithm reference signal (xed) can be described as: xed=TYSP*x. The residual noise at the ear drum area after the WB-ANC subsystem 110*w* (eed) can be described as: eed=ned−WB*xed, where "WB" is the WB-ANC subsystem 110*w* adaptive filter coefficient. WB can be updated according to the formula: WB=WB+mu*eed*x, where "mu" is an adaptation coefficient and can be a variable, depending on which adaptive filtering algorithm is used.

Embodiments can implement the NB-ANC subsystem 110*n* after the WB-ANC subsystem 110*w*, and the filter of the NB-ANC subsystem 110*n* can be adaptively updated according to an adaptation algorithm. For example, the WB-ANC subsystem 110*w* is a filter designed to minimize residual noise at the eardrum (i.e., the eardrum residual signal 335) without using the NB-ANC subsystem 110*n*, and where the reference noise signal 205*w* is the adaptive filter reference. The NB-ANC subsystem 110*n* is a filter designed to minimize residual noise at the eardrum (i.e., the eardrum residual signal 335), and where its adaptive filter reference and the noise to be minimized are both based on the residual noise at the eardrum after using the WB-ANC subsystem 110*w*. Thus, such an adaptation algorithm performs minimization twice, independently: the WB-ANC subsystem 110*w* attenuates larger bandwidth noise, and the NB-ANC subsystem 110*n* further reduces noise around the low-frequency range after the WB-ANC subsystem 110*w*. The residual noise after the WB-ANC subsystem 110*w* is filtered to account for the anti-noise path 120 and the ECNP 320 can be described as: xned=SPi*TYSP*eed. The formula for xned can be used as a reference for adaptation of the NB-ANC subsystem 110*n*. As such, the output signal from the NB-ANC subsystem 110*n*, the NB anti-noise contribution 215*n*, can be described as: yned=NB*xned. Thus, the residual noise after implementation of both the WB-ANC subsystem 110*w* and the NB-ANC subsystem 110*n* is eedn=eed−yned. The adaptive filter of the NB-ANC subsystem 110*n* can be updated with an adaptive filtering algorithm as follows: NB=NB+mu*eedn*xned.

As noted above, training results in K pre-trained ANC models 425, each corresponding to a particular wearer/wearing condition. Any one of the K pre-trained ANC models 425 can be "applied" to the ANC 110 by adjusting the filters (e.g., the filter coefficients, filter selections, etc.) based on parameters defined by the pre-trained ANC models 425. For example, each of the pre-trained ANC models 425 can correspond to a respective ANC filter (e.g., a set of filter coefficients and/or other parameters) set to implement the pre-trained ANC model 425, and applying the pre-trained ANC model 425 can involve effectively replacing the current ANC filter with the ANC filter corresponding to the pre-trained ANC model 425. Even though the error microphone 235 is located in the same conventional target location, applying any kth pre-trained ANC model 425*k* to the ANC 110 causes the ANC 110 to treat the error microphone 235 (e.g., respond to feedback from the error microphone 235) as if the error microphone 235 were located at the eardrum in a corresponding kth wearer/wearing condition. Thus, with a kth pre-trained ANC model 425*k* applied to the ANC 110, the adaptive noise canceling is performed by the ANC 110 in a manner that accounts for acoustical path effects of the entire MPED (e.g., including the tertiary path, ECNP 320, etc.) of the corresponding kth wearer/wearing condition.

Figure 4:
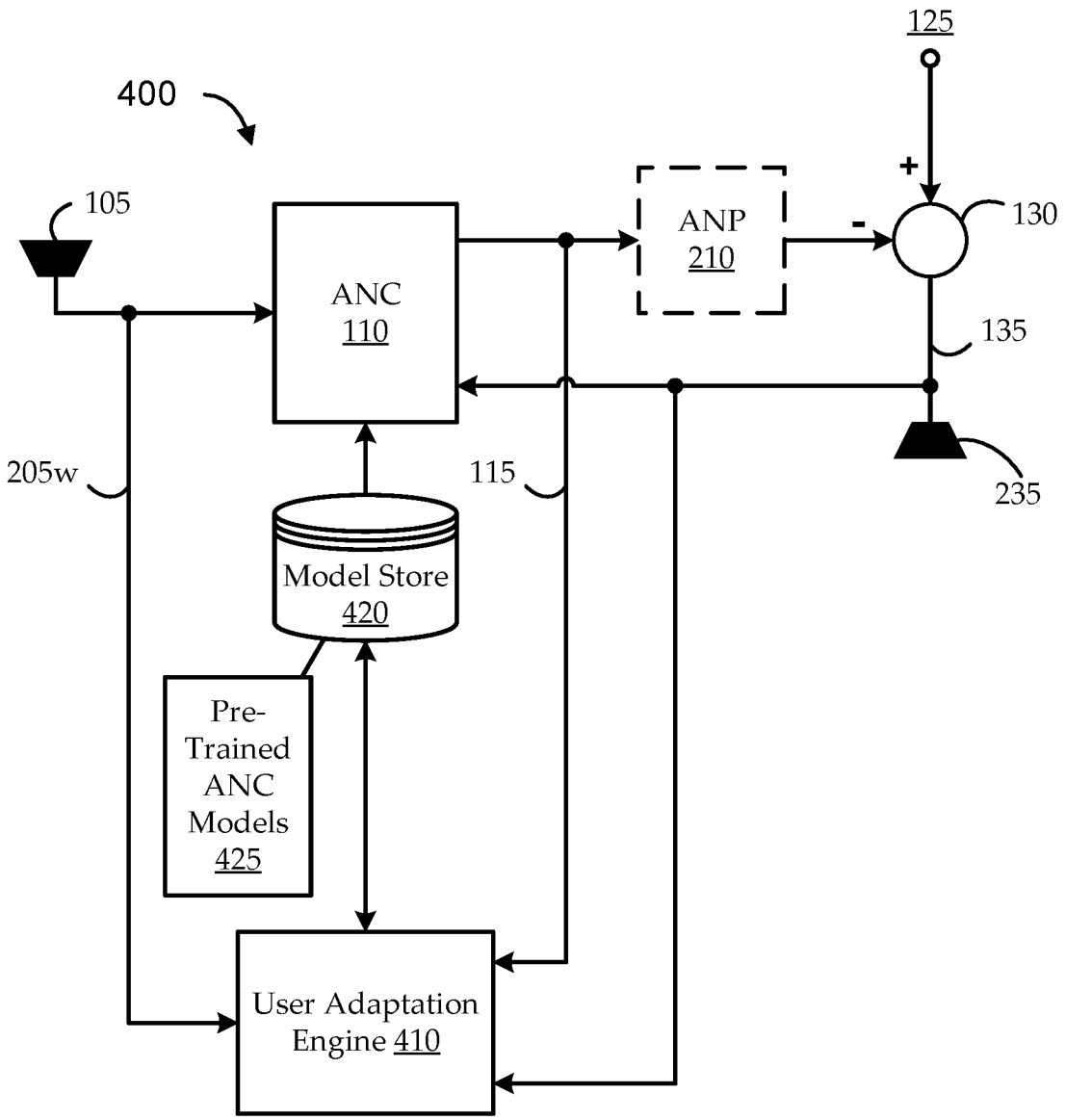
FIG. 4 shows a simplified block diagram of an illustrative ECFR-trained ANC architecture, according to various embodiments described herein.

FIG. 4 shows a simplified block diagram of an illustrative ECFR-trained ANC architecture 400, according to various embodiments described herein. Similar to the ANC architectures described in FIGS. 1-3, the ECFR-trained ANC architecture 400 can include an ANC 110 disposed between a reference microphone 105 and an error microphone 235. In general, the ANC 110 generates and outputs an anti-noise signal 115 based on one or more reference signals (e.g., based on a reference noise signal as recorded by the reference microphone 105 and on a feedback reference signal generated from a residual noise signal 135 as recorded by the error microphone 235). A version of ambient noise as manifest outside the ear (e.g., reference input 205*w*) is picked up both the reference microphone 105, and another version of the same ambient noise after traversing the main path (in-ear noise signal 125) is picked up by the error microphone 235. As described above, without any ECFR-based pre-training, the ANC 110 has no way to distinguish main-path effects from the MPEM and main-path effects from the MPED, and therefore the ANC 110 is unable to compensate for different wearer/wearing conditions.

As illustrated, the ECFR-trained ANC architecture 400 includes a user adaptation engine 410 and an ECFR-trained ANC model store 420. The ECFR-trained ANC model store 420 is any suitable data store having the K pre-trained ANC models 425 stored thereon. As described above, each of the K pre-trained ANC models 425 corresponds to a particular wearer/wearing condition. During use by a consumer, the user adaptation engine 410 is configured to quickly determine and select one of the pre-trained ANC models 425 from the ECFR-trained ANC model store 425 as most closely corresponding to the present wearer/wearing condition. Embodiments of the user adaptation engine 410 can then apply (or direct application of) the selected pre-trained ANC model 425 to the ANC 110. The determination and selection by the user adaptation engine 410 can be based on the reference input 205*w*, the anti-noise signal 115, and the residual noise signal 135. After application of the determined pre-trained ANC model 425 to the ANC 110, the ANC 110 can be allowed to perform adaptive noise cancelation, and such adaptive noise cancelation will automatically account for the entire MPED, not just the MPEM.

The pre-trained ANC models 420 can be trained to provide different types of filter configurations, depending on the ANC 110 architecture and/or other factors. For example, for an ANC 110 that only includes an error microphone 235 (i.e., there is no reference microphone 105, such as for a feedback-based ANC architecture), each pre-trained ANC model 420 can include a filter configuration representing a secondary path model and a filter configuration representing a NB-ANC subsystem 110*n* model. For an ANC 110 that includes both a reference microphone 105 and an error microphone 235 (e.g., a hybrid ANC architecture), each pre-trained ANC model 420 can include a filter configuration representing a secondary path model, a filter configuration representing a NB-ANC subsystem 110*n* model, and a filter configuration representing a WB-ANC subsystem 110*w* model. The filter configuration representing the NB-ANC subsystem 110*n* model and/or the WB-ANC subsystem 110*w* model is considered herein generally as an MPED model.

Figure 5:
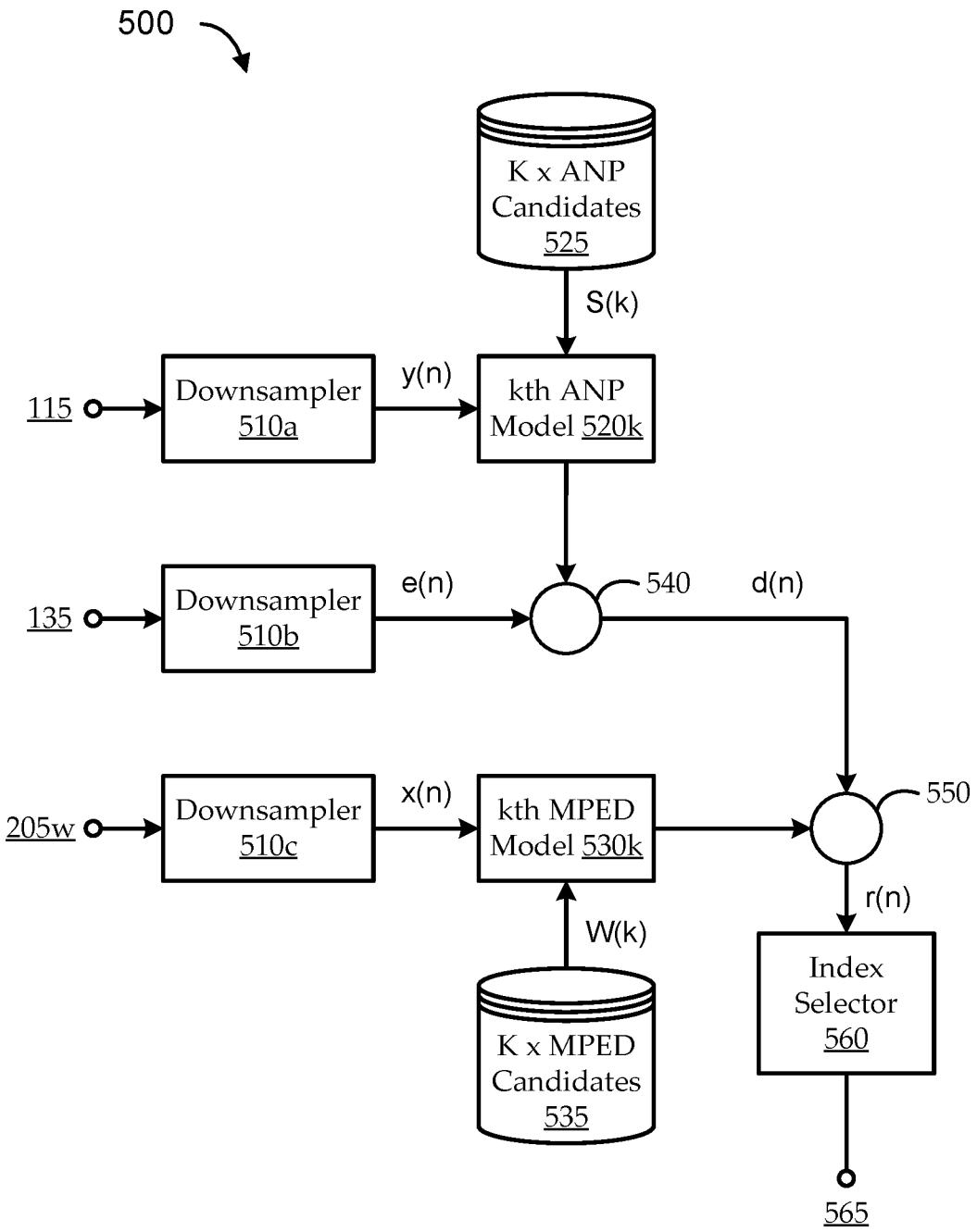
FIG. 5 shows an illustrative implementation of a user adaptation engine, according to various embodiments.

FIG. 5 shows an illustrative implementation of a user adaptation engine 500, according to various embodiments. Like the user adaptation engine 410 of FIG. 4, the user adaptation engine 500 of FIG. 5 takes, as inputs, the reference input 205*w* as recorded by the reference microphone 105, the anti-noise signal 115 as output by the ANC 110, and the residual noise signal 135 as recorded by the error microphone 235. In some implementations, as illustrated, each of those input signals can be passed through a respective downsampler 510. For example, a downsampled version of the reference input 205*w* (representing reference ambient noise) is illustrated as "x(n)"; a downsampled version of the anti-noise signal 115 (representing the output of the ANC 110) is illustrated as "y(n)"; and a downsampled version of the residual noise signal 135 (representing noise canceling error) is illustrated as "e(n)". For example, the ANC 110 can run at 768 Kilohertz, and the downsamplers 510 can convert each signal to an 8-Kilohertz signal, to a 4 Kilohertz signal, etc.

Embodiments of the user adaptation engine 500 can try each of the K pre-trained ANC models 425 to determine which of the pre-trained ANC models 425 most closely represents a present wearer/wearing condition. In some embodiments, each of the K pre-trained ANC models 425 is tried iteratively (e.g., sequentially), one at a time. In other embodiments, multiple instances of the user adaptation engine 500 are configured as parallel processing pipelines, such that multiple of the K pre-trained ANC models 425 are tried in parallel in each iteration. In some such embodiments, K parallel instances of the user adaptation engine 500 are used to try all K pre-trained ANC models 425 concurrently. As described above, each kth pre-trained ANC model 425*k* can include a kth MPED model 530*k* defining a filter, transfer function, etc. for the MPED of the kth wearer/wearing condition, and a kth ANP model 520*k* defining a filter, transfer function, etc. for the ANP (or MPEM) of the kth wearer/wearing condition. As such, the ECFR-trained ANC model store 425 of FIG. 4 can be considered as including an MPED model store 535 having K MPED model candidates stored thereon, and an ANP model store 525 having K ANP model candidates stored thereon.

In each kth trial, the user adaptation engine 500 seeks to estimate the actual main-path noise in the present wearer/wearing condition (i.e., the actual manifestation of the ambient noise at the target location, including acoustical effects across the actual MPED); to estimate a candidate noise representing what the main-path noise would be, if the ambient noise were traversing the modeled MPED corresponding to the kth pre-trained ANC model 425*k*; and to determine a candidate residual noise, r(n), as the difference between the estimated actual main path noise and the estimated candidate noise. The closer the actual MPED of the present wearer/wearing condition is to the modeled MPED of a particular pre-trained ANC model 425, the smaller r(n) will be. As such, the user adaptation engine 500 can select the pre-trained ANC model 425 that produces the smallest r(n). In some embodiments, prior to filter selection, noise signals can be equalized to one of several preconfigured "typical" noise types. This can help account for large differences in ambient noise from one location to another location.

Embodiments of the user adaptation engine 500 can estimate the actual main-path noise in the present wearer/wearing condition by essentially removing the anti-noise signal 115 from the residual noise signal 135. For example, if there were no ANC 110, there would be no anti-noise signal 115, and the error microphone 235 would record the actual noise at the target location (i.e., the in-ear noise signal 125). However, because the anti-noise signal 115 is being output by the ANC 110, the error microphone 235 records the residual noise signal 135, which is a combination of the noise at the target location and the anti-noise signal 115. Further, the anti-noise signal 115 as output at the target location is actually a version of the anti-noise signal 115 after traversing the anti-noise path 120. Thus, to obtain an estimate of the actual noise at the target location for a kth trial, the anti-noise signal 115 (or the downsampled version, y(n)) is passed to the kth ANP model 520*k* to generate a path-compensated estimate of the anti-noise signal 115 as output at the target location. At a summing node 540 (e.g., implemented as an adder, subtracter, or in any suitable manner), that path-compensated estimate of the anti-noise signal 115 is subtracted from the residual noise signal 135 (or the downsampled version, e(n)) to effectively leave behind the estimate of the actual noise, d(n). For example, d(n) can be described as e(n)−y(n)*S(k), where S(k) is a functional representation of the kth ANP model 520*k*.

To estimate the candidate noise, embodiments can pass the reference input 205*w* (or the downsampled version, x(n)) to the kth MPED model 530*k*, thereby transforming the ambient noise (as represented by reference input 205*w*) into an estimated eardrum noise signal based on modeled acoustical path effects across an entire MPED of the wearer/wearing condition corresponding to the kth pre-trained ANC model 425*k*. For example, the output of the kth MPED model 530*k* is x(n)*W(k), where W(k) is a functional representation of the kth MPED model 530*k*. At a summing node 550 (e.g., implemented as an adder, subtracter, or in any suitable manner), embodiments combine the output of the kth MPED model 530*k* with the actual noise estimate, d(n), to generate the candidate residual noise, r(n).

Some embodiments estimate the actual noise (d) and the candidate residual noise (r) according to an algorithm, such as the following:

for k=1:N $d=e+s*y';$ $r=d-w*x';$ $D(k)=D(k)+d;$ $R(k)=R(k)+r;$ end

The K trials (e.g., performed serially, partially in parallel, or completely in parallel), can result in generation of K r(n) signals. Each of the K r(n) signals is associated with an index (e.g., k) corresponding to which of the K pre-trained ANC models 425 resulted in that r(n). Embodiments of the user adaptation engine 500 include an index selector 560 to output a selected index 565 indicating the index of one of the K pre-trained ANC models 425 selected to apply to the ANC 110 based on determining which of the K pre-trained ANC models 425 results in the smallest r(n). The smallest r(n) can be determined by determining which of the K r(n) signals represents a minimum least mean square error. As described above, the selected index 565 corresponds to whichever pre-trained ANC model 425 has a modeled MPED that most closely matches the MPED of the present wearer/wearing condition. By applying the selected pre-trained ANC model 425 (corresponding to the selected index 565) to the ANC 110, such as in FIG. 4, the ANC 110 can achieve improved performance both in depth of noise reduction in low frequency ranges and in width of noise reduction frequency.

The user adaptation engine 500 can apply, or direct application of, the selected pre-trained ANC model 425 to the ANC 110 in any suitable manner. In some implementations, the user adaptation engine 500 sends one or more control signals to the ANC 110 (e.g., to the WB-ANC subsystem 110*w* and/or to the NB-ANC subsystem 110*n*) to adjust ANC filter coefficients and/or otherwise configure ANC filters based on the selected pre-trained ANC model 425. In other implementations, the user adaptation engine 500 sends one or more control signals to the ANC 110 to indicate the selected index 565, and the ANC 110 maps the selected index 565 to a stored set of filter coefficients and/or other filter configurations, accordingly. For example, the ANC 110 includes a lookup table that maps each of the K indexes to a corresponding one of K set of ANC filter configuration parameters.

The above features of the user adaptation engine 500 can generally be referred to as "filter selection." In some embodiments, the user adaptation engine 500 performs filter selection as part of an initial setup. For example, a wearer inserts one or both earpieces in their ears and begins to play desired audio. Just before or just after beginning playback of the desired audio, the user adaptation engine 500 can perform the index selection to find optimal initial ANC filter settings for the ANC 110. The ANC 110 can then be left to dynamically adapt to changes in ambient noise. In some embodiments, the user adaptation engine 500 performs filter selection in response to an explicit request from a user. For example, the user presses a button on the headphones, which triggers filter selection.

In some embodiments, the user adaptation engine 500 continues to perform filter selection throughout use of the headphones, such as continuously, or periodically. Use of the downsamplers 510 can appreciably reduce the amount of power, time, computation resources, and/or other resources needed to perform filter selection, such that embodiments can continuously re-execute the filter selection without an appreciable burden on the headphone system. During use, a wearer can purposefully adjust the position of earpieces in the ears (or switch out earbud tips, etc.), or the position of the earpieces in the ears can shift inadvertently (e.g., by becoming looser during use, etc.). By continuously re-executing the filter selection, the user adaptation engine 500 can continue to ensure whichever one of the pre-trained ANC models 425 is being used to as a basis for the ANC 110 filter configurations continues to be optimal even as the wearer/wearing condition changes.

In some such embodiments, a new selected index 565 is applied to the ANC 110 whenever the filter selection determines that a present selected index 565 is not the most optimal. For example, R(k) represents the candidate residual noise for a particular index (k), and D(k) represents the actual noise estimate for the same index (k). The filter selection by the user adaptation engine 500 seeks to minimize a residual error ratio, i(k), where i(k)=R(k)/D(k). Suppose a presently selected index 565 is 'p', and the index in each re-executed trial is 'n'; so that the present residual error ratio is i(p)=R(p)/D(p), and each newly tried residual error ratio is i(n)=R(n)/D(n). Some embodiments can select the newly tried index, n, whenever i(n) is less than i(p). For example, a lower residual error ratio indicates that the pre-trained ANC model 425 corresponding to the newly tried index is a closer fit to the actual MPED of the present wearer/wearing condition than the MPED represented by a present ANC filter configuration. Other embodiments can select the newly tried index, n, whenever i(n) is less than i(p) by at least a predetermined threshold value. As one example, suppose the ANC 110 is presently configured according to the pre-trained ANC model 425 with index '5', and re-execution of the index selection results in pre-trained ANC model 425 with index '10' now manifesting a more optimal candidate residual noise. Embodiments can determine to switch the selected index 565 from '5' to '10' and can update the ANC 110 accordingly.

Figure 6:
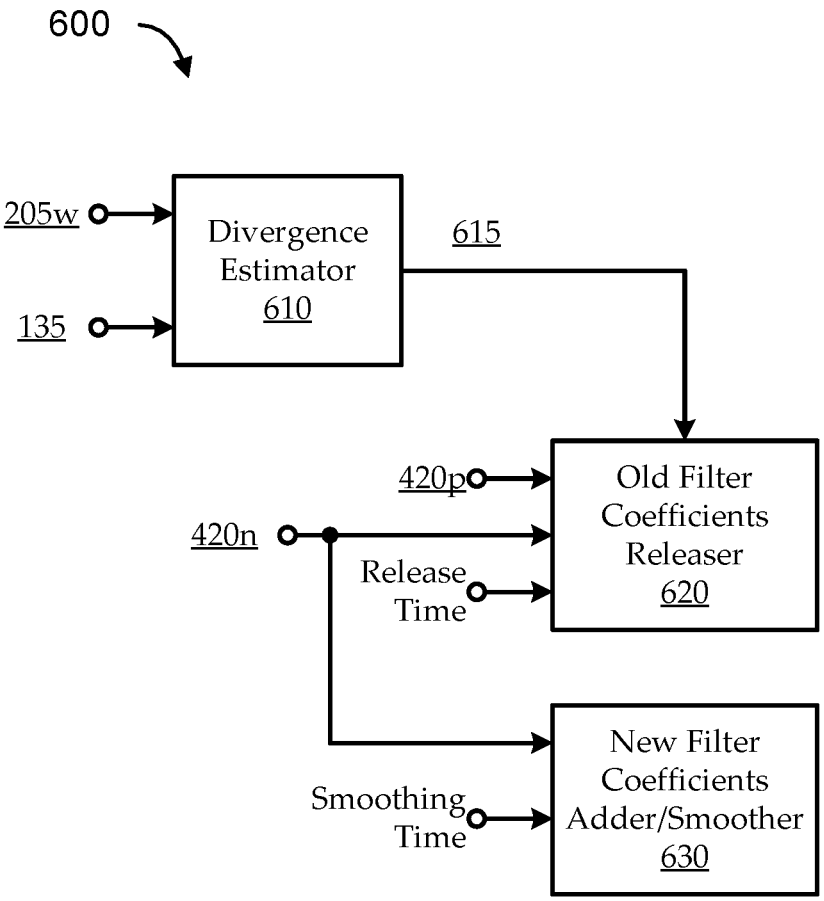
FIG. 6 shows an example operational block diagram to switch from one ANC filter configuration to another ANC filter configuration based on updating a selected index responsive to filter selection by the user adaptation engine.

In some implementations, updating an index can be performed abruptly. In the above example, the ANC 110 filter configurations associated with a selected index 565 of '5' are abruptly replaced with ANC 110 filter configurations associated with a selected index 565 of '10'. In other implementations, updating an index can be performed in a gradual and/or smoothed-out fashion. FIG. 6 shows an example operational block diagram 600 to switch from one ANC filter configuration to another ANC filter configuration based on updating a selected index 565 responsive to filter selection by the user adaptation engine 500. As described above, sets of filter coefficients (e.g., generally intended to include any suitable filter configuration parameters) are defined by pre-trained ANC models 425, and each pre-trained ANC model 425 is associated with an index. The context of FIG. 6 assumes that a previous filter selection was performed by the user adaptation engine 500, resulting in a present (old) selected index 565 corresponding to a selected one of the pre-trained ANC models 425. Prior to any change in filter selection, the ANC 110 filter configuration is set according to at least the set of filter coefficients defined by the "old" selected index 565. The context further assumes that a subsequent filter selection has now been performed by the user adaptation engine 500, resulting in a new selected index 565 corresponding to a newly selected one of the pre-trained ANC models 425, and that it is desirable to update the ANC 110 filter configuration according to the newly selected pre-trained ANC model 425.

As illustrated, a divergence estimator block 610 can produces a divergence flag (div_flag) 615 based on inputs from the error microphone 235 (e.g., the residual noise signal 135) and the reference microphone 105 (e.g., the reference input 205*w*). As illustrated, one of the inputs can be a "leaking indicator," which can be a ratio between the error microphone 235 and the reference microphone 105 inputs. For example, when the residual noise signal 135 increases to a threshold level (err_th) so that the leaking indicator is above a different threshold level (li_th), the div_flag 615 can be asserted (e.g., set to '1', set to HIGH, etc.), indicating that the noise correction being performed by the ANC 110 is trending toward divergence. When the residual noise signal 135 is decreasing to below the err_th so that the leaking indicator is below li_th, the div_flag 615 can be de-asserted (e.g., set to '0', set to LOW, etc.), indicating that the noise correction being performed by the ANC 110 is trending toward stabilization.

An old filter coefficients releaser block 620 can takes the present (old) ANC filter coefficients (defined by present pre-trained ANC model 425*p*), the new ANC filter coefficients (defined by new pre-trained ANC model 425*n*), the divergence flag 615, and a release time as inputs. The old filter coefficients releaser block 620 can operate differently, depending on the state of the divergence flag 615, as received from divergence estimator block 610. If there is no divergence, embodiments can replace poles and zeros in the old ANC filter configuration wherever the poles and zeros of the new ANC filter configuration are close to those of the old one. Other poles and zeros of the old ANC filter configuration can be replaced with zeros. After replacement, the ANC 110 can maintain that state until the release time elapses. If there is divergence, embodiments can replace all poles and zeros in the old ANC filter configuration with zeros. After replacement, the ANC 110 can maintain that state until the release time elapses.

For example, once the divergence estimator block 610 detects divergence, present ANC filter coefficients are released, and adaptation is frozen to prevent divergence to howling. Ideally, ANC filter states can be set to zero, particularly when an infinite impulse response (IIR) filter is used because zero-input response may persist. If filter states are not accessible, the ANC 110 can wait until the zero-input response decays. When a noise pump has decayed so that the leaking indicator is smaller than the threshold, ANC adaptation can start, or restart. When filter selection is complete and there is a new selected index 565, the ANC 110 can be updated with a new filter configuration corresponding to the new selected index 565. When there is uncertainty as to whether the ANC 110 states were released for the new ANC filter configuration, inputs to the ANC 110 can be gradually increased to a normal level. Divergence resulting from ANC filter switching is typically an artifact of the NB-ANC subsystem 110*n*, which filters based on feedback and performs noise reduction primarily on low frequencies. Embodiments of the NB-ANC subsystem 110 can be designed so that the filter is a high-performance low-pass filter with a stopband in any frequency regions where noise has no attenuation.

A new filter adder and smoother block 630 can take the new ANC filter coefficients and a smoothing time as inputs. In one implementation, the new filter adder and smoother block 630 can write new coefficients into the ANC filter location, gradually increases the ANC input signal level to a normal level within the smoothing time. In another implementation, the new filter adder and smoother block 630 holds the release period for the smoothing time, after which the new filter coefficients are made available to the ANC 110. In another implementation, the new filter adder and smoother block 630 gradually scales up the ANC filter coefficients to designated values over the smoothing time.

Approaches described above generally obtain and exploit pre-trained ANC models 420, including using downsampled filter selection, to reduce the cost and complexity of filter adaptation for the ANC 110. Other approaches can use some similar techniques. One such alternate approach, which can be considerably more costly, is to train the ANC 110 directly. As described herein, noise reduction performance can be best when the ANC filter configuration is trained for a wearer/wearing condition that substantially matches a present wearer/wearing condition. If not, an ANC filter configuration can be selected as an initial best option relative to other candidate configurations, and adaptive filtering running in real-time can be applied to further improve the ANC 110 performance. Instead of using pre-trained ANC models 420, approaches can apply all ANC 110 parameters and filters to the ANC 110 input data, while the ANC 110 is disabled. For example, if there are K potential filter configurations, each configuration can be tried in the ANC 110 to generate K corresponding residual noise signals, and the various residual noise signals can be compared to find the configuration that provides optimal ANC 110 performance. As described above, the performance can be evaluated based on factors, such as optimizing depth of noise reduction around low frequencies, width of noise reduction frequency, and total noise reduction. With such an approach, it can be desirable to minimize the time during which the ANC is disabled for filter selection to limit the impact on the wearer's comfort and listening experience. Because the different filter configurations are being tried at full rate (i.e., at the first sampling rate of the ANC 110), it can be costly (i.e., it can take appreciable power, computing, and/or time resources) to try a significant number of different candidate configurations.

Another alternative approach is to train the ANC 110 while a wearer is wearing the device. With such approaches, it can be desirable to ensure that the training time is very short, such as 1 or 2 seconds. With such an approach, to train a secondary path impulse response (e.g., ANPi 220), the ANC 110 anti-noise signal 115 output can be disabled. Instead, the ANC 110 can transmit a segment of music, pink noise, or other signal for a specified first training time window (e.g., approximately 1 second). A particular segment of data can also be used to train filter coefficients to represent a secondary path model (e.g., similar to an ANP model 520). To train the ANC filter impulse response (e.g., WB and/or NB filters, similar to a MPED model 530), ambient noise can be captured with the error microphone 235 and/or reference microphone 105 for a second training time window (e.g., approximately 1 second), while the ANC 110 anti-noise signal 115 output is disabled.

Some such approaches can train the ANC 110 in a warped frequency domain. Frequency warping is designed such that lower frequency components have higher resolution, and high frequency components have lower resolution. In this way, a few frequency bins can be sufficient for generating ANC filters. For example, in real-time, a frequency response can be computed for each block of data (e.g., 4 ms) with chosen frequency bins. A time domain window can be applied when computing the frequency response to reduce response variation. Such a block-based computation can tend to distribute the computation burden over the blocks.

Other such approaches can train the ANC 110 directly in the time domain. The obtained time-domain data can be down-sampled and input into an adaptive algorithm. For each piece of data, the adaptive algorithm is repeatedly applied, and the timing of adaptive filtering is guaranteed to be normal. A very good low-sampling-frequency finite impulse response (FIR) ANC filter can be obtained. The ANC 110 can include an algorithm module to converts the ANC 110 from a low sampling frequency to a high sampling frequency, and also has an algorithm module to convert the FIR filter to an IIR filter. Such approaches can generate a filter that is relatively smooth and reliable in the frequency domain, because the adaptive filtering algorithm can reduce the interference components in the input signal under suitable conditions.

Other such approaches can train the ANC 110 by converting input data into frequency-warped time-domain data. The amount of data generated can be much smaller, and the warped-frequency FIR ANC length can be very short using such an approach. Such approaches are compatible with the same types of adaptive algorithms as other approaches. The ANC 110 can have an algorithm module for converting the ANC 110 from warped-frequency to high sampling frequency and an algorithm module for converting from warped-frequency FIR to IIR.

Figure 7:
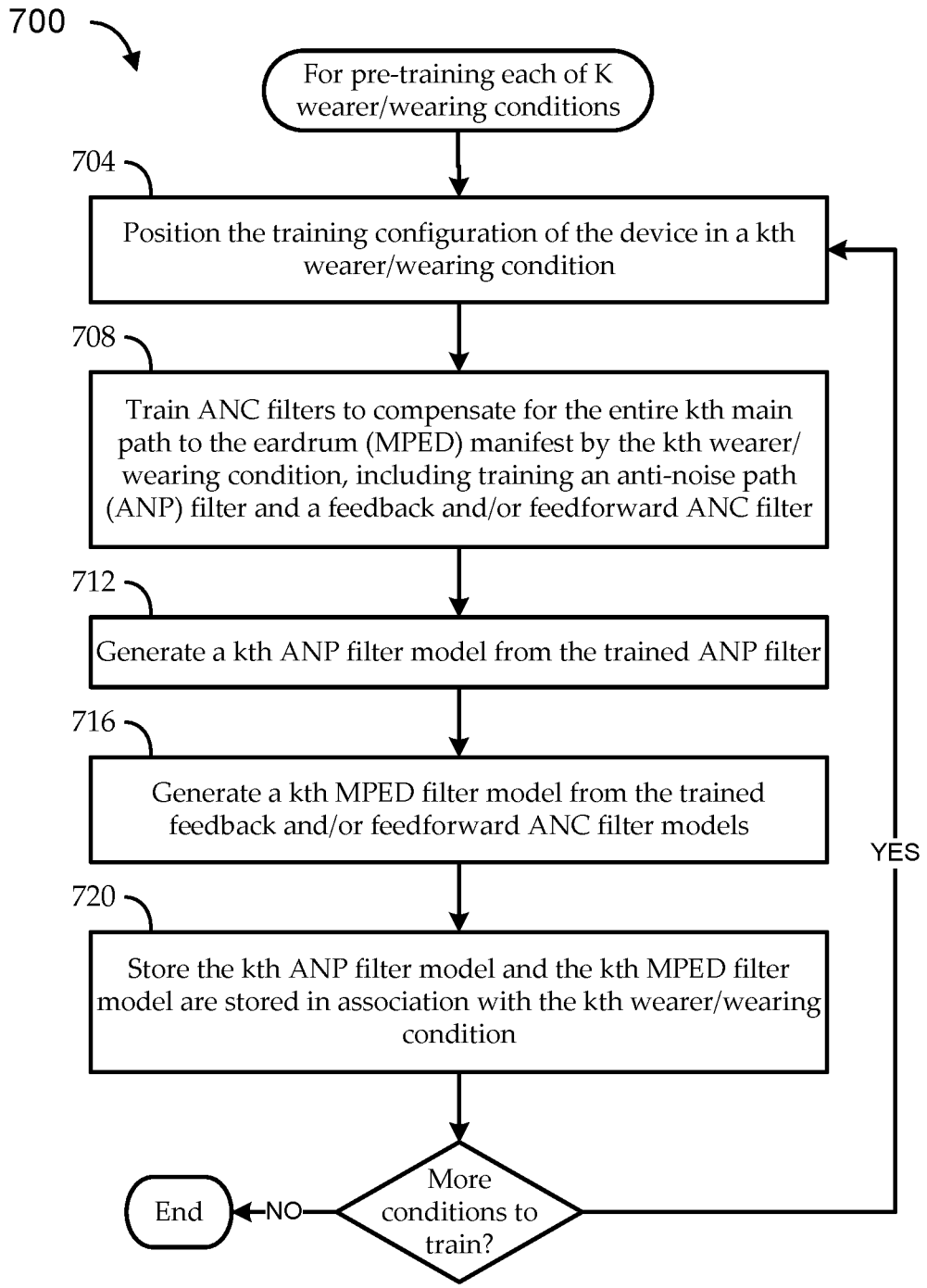
FIG. 7 shows a flow diagram of an illustrative method for ear-cavity frequency response-based pre-training of ANC models, according to various embodiments described herein.

FIG. 7 shows a flow diagram of an illustrative method 700 for ear-cavity frequency response-based pre-training of ANC models, according to various embodiments described herein. As described herein, some pre-training can be performed in a laboratory environment using a training configuration of the headphone earpiece that includes a physical eardrum microphone configured to be positioned at the eardrum of an individual wearing the device (or of a manufactured analog of an outer ear and eardrum). Embodiments of the method 700 begin at stage 704 by positioning the training configuration of the device in a wearer/wearing condition. It is assumed that the method 700 will be performed for K (e.g., 50) wearer/wearing conditions, such that the stages of the method 700 represent a kth performance of the method corresponding to a kth wearer/wearing condition.

At stage 708, with the device positioned in the kth wearer/wearing condition, ANC filters can be trained to compensate for the entire MPED (i.e., the kth WIPED created by the kth wearer/wearing condition). Such training can involve training an anti-noise path (ANP) filter, and training a feedback (narrowband) ANC filter and/or a feedforward (wideband) ANC filter. At stage 712, embodiments can use the trained ANP filter to generate a kth ANP filter model. At stage 716, embodiments can use the trained feedback and/or feedforward ANC filter models to generate a kth MPED filter model. At stage 720, the kth ANP filter model and the kth MPED filter model are stored in association with the kth wearer/wearing condition (e.g., using indexing). For example, during subsequent production use, any particular ANC filter configuration defined by a corresponding one of the K pre-trained ANC models (including its kth ANP filter model and its kth MPED filter model) can be identified by its index and applied to set the filter configuration of the ANC system of the headphone earpiece.

Figure 8:
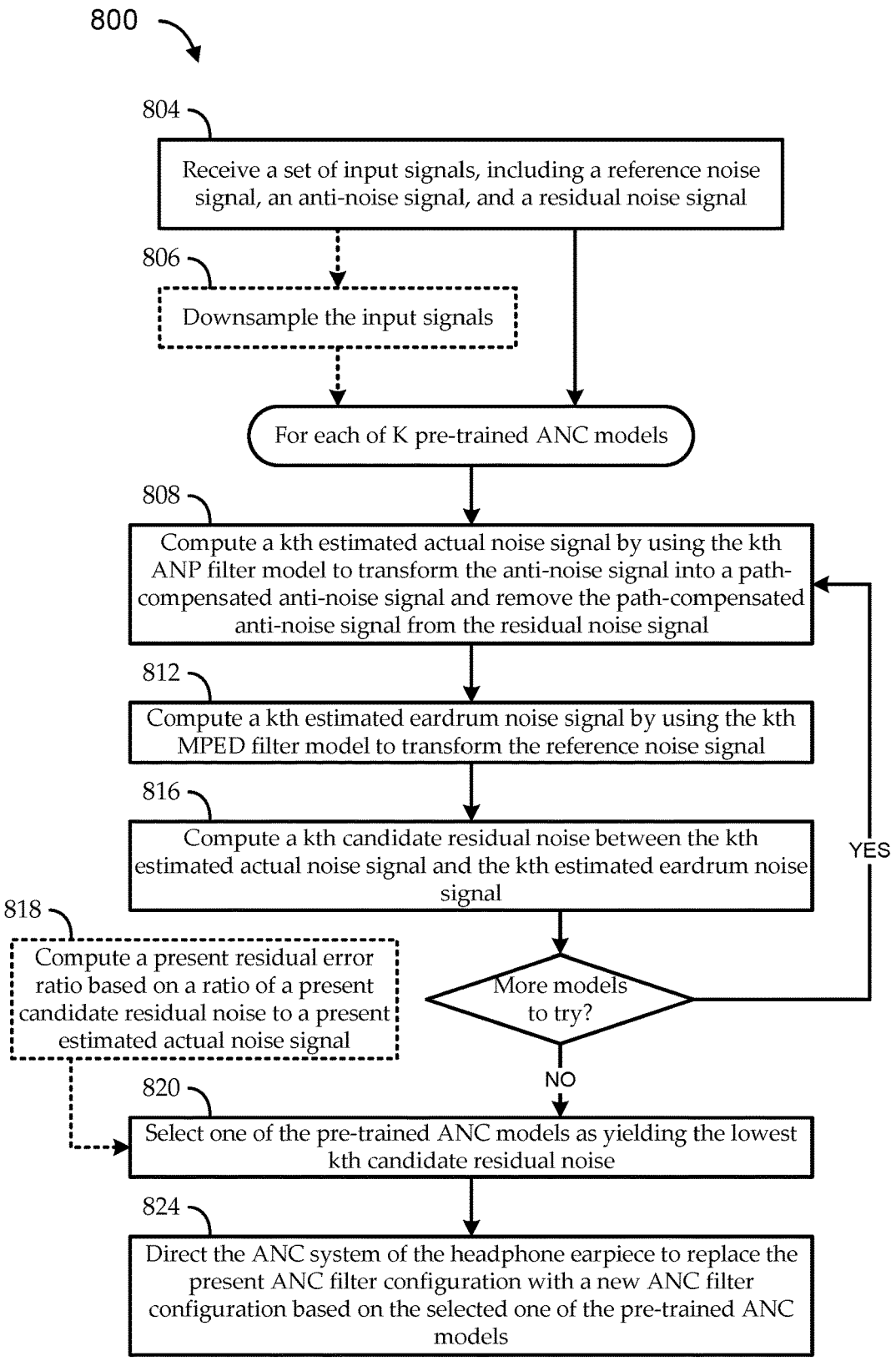
FIG. 8 shows a flow diagram of an illustrative method for ear cavity frequency response (EFCR) adaptive noise cancelation (ANC) with path-compensation over an entire main path to the eardrum (MPED), according to various embodiments described herein.

FIG. 8 shows a flow diagram of an illustrative method 800 for ear cavity frequency response (EFCR) adaptive noise cancelation (ANC) with path-compensation over an entire main path to the eardrum (MPED), according to various embodiments described herein. Embodiments of the method 800 operate while a user is wearing a headphone earpiece to manifest a present wearer/wearing condition relative to an outer ear of the user. For example, the user has placed a headphone earpiece in at least one of his or her ears, and the user may or may not be presently playing desired audio. Embodiments begin at stage 804 by receiving a set of input signals. One input signal is a reference noise signal (e.g., reference input 205*w*) representing ambient noise at an out-facing side of the headphone earpiece. Another input signal is an anti-noise signal (e.g., anti-noise signal 115) generated by an ANC system of the headphone earpiece using a present ANC filter configuration to cancel an in-ear noise signal corresponding to the ambient noise as manifest at a target location at an in-facing side of the headphone earpiece due to acoustical path effects of the MPED. Another input signal is a residual noise signal (e.g., residual noise signal 135) representing a combination of the anti-noise signal and the in-ear noise signal. In some embodiments, the residual noise signal is received by an error microphone disposed at an in-facing side of the headphone earpiece. In some embodiments, the reference noise signal is received by a reference microphone disposed at an out-facing side of the headphone earpiece.

Embodiments of the method 800 continue with filter selection at stages 808-816. Filter selection can be performed over K trials corresponding to K pre-trained ANC models, where K is a positive integer greater than 1. Typically, K is much larger than 1, such as where K is 50, 100, 1000, etc. In some implementations, stages 808-816 are performed K times sequentially, once for each of the K pre-trained ANC models. In other implementations, stages 808-816 are performed in parallel on all K pre-trained ANC models, such that a single iteration of stages 808-816 includes K concurrently performances of stages 808-816. In other implementations, each iteration of stages 808-816 is performed in parallel on multiple, but not all, pre-trained ANC models, such that more than 1 and fewer than K iterations are performed.

Each kth pre-trained ANC model includes a kth anti-noise path (ANP) filter model and a kth MPED filter model previously trained on a kth trained wearer/wearing condition. As described herein, some embodiments of the ANC system include a feedback ANC filter subsystem that generates a narrow-band (NB) contribution to the anti-noise signal by transforming a feedback reference signal based on a set of NB filter coefficients. The feedback reference signal is generated from the residual noise signal as detected by an error microphone of the headphone earpiece located substantially at the target location. In such embodiments, each kth MPED filter model includes a kth feedback ANC filter model defining a kth set of values for configuring the set of NB filter coefficients. Other embodiments of the ANC system further include a feedforward ANC filter subsystem that generates a wide-band (WB) contribution to the anti-noise signal by transforming the reference noise signal based on a set of WB filter coefficients. In such embodiments, each kth MPED filter model further includes a kth feedforward ANC filter model defining a kth set of values for configuring the set of WB filter coefficients. For example, in context of a hybrid ANC architecture, each of the K pre-trained ANC models can define an ANP filter model and a MPED filter model that includes both a feedback ANC filter model and a feedforward ANC filter model.

As described herein, each of the K pre-trained ANC models is pre-trained based on using a training configuration of the headphone earpiece in each of K training wearer/wearing conditions. In the operational context of the method 800, the user is wearing a production configuration of the headphone earpiece that does not include an eardrum microphone (e.g., it typically includes an error microphone, and it may also include a reference microphone). In contrast, the training configuration of the headphone earpiece includes both an error microphone at the target location and an eardrum microphone for positioning at an eardrum of a training wearer in each kth trained wearer/wearing condition. In some cases, the training wearers include one or more human users, and training configuration of the headphone earpiece is placed in the outer ear of the one or more human users to manifest each training wearer/wearing condition. In other cases, the training wearer is a realistic analog of an outer ear that closely mimics the outer ear anatomy and physiology (including that of an eardrum) of one or more actual human users.

Because the training configuration of the headphone earpiece includes both an error microphone and an eardrum microphone, each kth MPED filter model can be trained based on direct concurrent measurements of manifestations of a same reference noise at the target location by the error microphone and at the eardrum by the eardrum microphone. For example, in each kth trained wearer/wearing condition, the error microphone is positioned in a respective training target location of a respective training wearer's outer ear, while the eardrum microphone is positioned in the respective training wearer's eardrum. This can define a kth ear cavity noise path between the respective training target location and the respective training wearer's eardrum, such that each kth MPED filter model is trained to compensate for ECFR effects of the kth ear cavity noise path.

At stage 808, embodiments can compute a kth estimated actual noise signal by using the kth ANP filter model to transform the anti-noise signal into a path-compensated anti-noise signal, and embodiments can remove the path-compensated anti-noise signal from the residual noise signal. At stage 812, embodiments can compute a kth estimated eardrum noise signal by using the kth MPED filter model to transform the reference noise signal. At stage 816, embodiments can compute a kth candidate residual noise between the kth estimated actual noise signal and the kth estimated eardrum noise signal.

The ANC system of the headphone earpiece operates at a first sampling rate. In some embodiments, the method 800 further includes downsampling the input signals at stage 806 prior to performing filter selection. In particular, such embodiments include downsampling the reference noise signal from a first sampling rate of the ANC system to a second sampling rate to generate a downsampled reference noise signal; downsampling the anti-noise signal from the first sampling rate to the second sampling rate to generate a downsampled anti-noise signal; and downsampling the residual noise signal from the first sampling rate to the second sampling rate to generate a downsampled residual noise signal. The second sampling rate is much less than the first sampling rate, such as less than five percent of the first sampling rate. For example, the first sampling rate is around 800 Kilohertz, and the second sampling rate is around 8 Kilohertz (approximately 1 percent), or even 4 Kilohertz (approximately 0.5 percent). In such embodiments, each kth ANP filter model and each kth MPED filter model runs at the second sampling rate. Computing the kth estimated actual noise signal can use the kth ANP filter model to transform the downsampled anti-noise signal into the path-compensated anti-noise signal, and can remove the path-compensated anti-noise signal from the downsampled residual noise signal. Computing the kth estimated eardrum noise signal can use the kth MPED filter model to transform the downsampled reference noise signal.

At stage 820, embodiments can select one of the pre-trained ANC models as yielding the lowest kth candidate residual noise. At stage 824, embodiments can direct the ANC system of the headphone earpiece to replace the present ANC filter configuration with a new ANC filter configuration based on the selected one of the pre-trained ANC models. In some embodiments, at stage 818, the method 800 can compute a present residual error ratio based on a ratio of a present candidate residual noise to a present estimated actual noise signal, the present candidate residual noise and the present estimated actual noise signal being associated with the present ANC filter configuration. In such embodiments, the selecting at stage 820 can include, for each kth pre-trained ANC model, computing a kth residual error ratio based on a ratio of the kth candidate residual noise to the kth estimated actual noise signal, and selecting the one of the pre-trained ANC models as yielding the lowest residual error ratio. Further, in such embodiments, the directing at stage 824 can be performed responsive to detecting that the lowest residual error ratio is less than the present residual error ratio. In some such embodiments, the detecting at stage 824 can be performed responsive to detecting that the lowest residual error ratio is less than the present residual error ratio by at least a predetermined threshold amount.

In some embodiments, the directing at stage 824 includes freezing adaptation of the ANC system for a predetermined release time; prior to elapsing of the release time, releasing present filter coefficients defined by the present ANC filter configuration; and upon elapsing of the release time, writing new filter coefficients to the ANC system as defined by the new ANC filter configuration, and gradually unfreezing adaptation by the ANC system according to the new ANC filter configuration over a predetermined smoothing time. In some such embodiments, the gradually unfreezing adaptation can be performed either by gradually increasing an ANC input signal level to a normal level within the smoothing time, the normal level being the ANC input signal level prior to the freezing, or by gradually scaling from released filter coefficient values to values defined by the new filter coefficients over the smoothing time. In some such embodiments, releasing the present filter coefficients can include determining whether there is a divergence condition by determining whether both the residual noise signal presently exceeds a predetermined error threshold level, and a leakage indicator presently exceeds a predetermined leakage threshold level, the leakage indicator being a ratio between the residual noise signal and the reference noise signal. If there is a divergence condition, such embodiments can replace old poles/zeros defined by the present ANC filter configuration with all zeros. If there is no divergence condition, such embodiments can, for each of the old poles/zeros: replace the old pole/zero with a corresponding one of new poles/zeros defined by the new ANC filter configuration if the old pole/zero is within a predetermined threshold distance of the corresponding one of the new poles/zeros; and replace the old pole/zero with a zero if the old pole/zero is not within the predetermined threshold distance of the corresponding one of the new poles/zeros.

The embodiments disclosed herein are not limited in scope by the specific embodiments described herein. Various modifications of the embodiments of the present invention, in addition to those described herein, will be apparent to those of ordinary skill in the art from the foregoing description and accompanying drawings. Further, although some of the embodiments of the present invention have been described in the context of a particular implementation in a particular environment for a particular purpose, those of ordinary skill in the art will recognize that its usefulness is not limited thereto and that the embodiments of the present invention can be beneficially implemented in any number of environments for any number of purposes.

What is claimed is:

1. A method for ear cavity frequency response (EFCR) adaptive noise cancelation (ANC) with path-compensation over an entire main path to the eardrum (MPED), the method comprising:

receiving, while a user is wearing a headphone earpiece to manifest a present wearer/wearing condition relative to an outer ear of the user, a reference noise signal representing ambient noise at an out-facing side of the headphone earpiece, an anti-noise signal generated by an ANC system of the headphone earpiece using a present ANC filter configuration to cancel an in-ear noise signal corresponding to the ambient noise as manifest at a target location at an in-facing side of the headphone earpiece due to acoustical path effects of the MPED, and a residual noise signal representing a combination of the anti-noise signal and the in-ear noise signal;

for each kth pre-trained ANC model of K pre-trained ANC models, each having a kth anti-noise path (ANP) filter model and a kth MPED filter model previously trained on a kth trained wearer/wearing condition, K being a positive integer greater than one:

computing a kth estimated actual noise signal by using the kth ANP filter model to transform the anti-noise signal into a path-compensated anti-noise signal, and removing the path-compensated anti-noise signal from the residual noise signal;

computing a kth estimated eardrum noise signal by using the kth MPED filter model to transform the reference noise signal; and computing a kth candidate residual noise between the kth estimated actual noise signal and the kth estimated eardrum noise signal;

selecting one of the pre-trained ANC models as yielding the lowest kth candidate residual noise; and directing the ANC system of the headphone earpiece to replace the present ANC filter configuration with a new ANC filter configuration based on the selected one of the pre-trained ANC models.

2. The method of claim 1, wherein the ANC system of the headphone earpiece operates at a first sampling rate, and further comprising:

downsampling the reference noise signal from a first sampling rate of the ANC system to a second sampling rate that is less than five percent of the first sampling rate to generate a downsampled reference noise signal;

downsampling the anti-noise signal from the first sampling rate to the second sampling rate to generate a downsampled anti-noise signal; and downsampling the residual noise signal from the first sampling rate to the second sampling rate to generate a downsampled residual noise signal, wherein each kth ANP filter model and each kth MPED filter model runs at the second sampling rate, the computing the kth estimated actual noise signal uses the kth ANP filter model to transform the downsampled anti-noise signal into the path-compensated anti-noise signal, and removes the path-compensated anti-noise signal from the downsampled residual noise signal, and the computing the kth estimated eardrum noise signal uses the kth MPED filter model to transform the downsampled reference noise signal.

3. The method of claim 1, wherein:

the user is wearing a production configuration of the headphone earpiece that does not include an eardrum microphone;

the K pre-trained ANC models are previously trained using a training configuration of the headphone earpiece that comprises an error microphone at the target location and the eardrum microphone for positioning at a respective training wearer's eardrum in each kth trained wearer/wearing condition, such that each kth MPED filter model is trained based on direct concurrent measurements of manifestations of a same reference noise at the target location by the error microphone and at the eardrum by the eardrum microphone.

4. The method of claim 3, wherein:

in each kth trained wearer/wearing condition, the error microphone is positioned in a respective training target location of a respective training wearer's outer ear, while the eardrum microphone is positioned in the respective training wearer's eardrum, thereby defining a kth ear cavity noise path between the respective training target location and the respective training wearer's eardrum, such that each kth MPED filter model is trained to compensate for ECFR effects of the kth ear cavity noise path.

5. The method of claim 1, wherein:

the ANC system of the headphone earpiece comprises a feedback ANC filter subsystem that generates a narrow-band (NB) contribution to the anti-noise signal by transforming a feedback reference signal based on a set of NB filter coefficients, the feedback reference signal generated from the residual noise signal as detected by an error microphone of the headphone earpiece located substantially at the target location; and each kth MPED filter model comprises a kth feedback ANC filter model defining a kth set of values for configuring the set of NB filter coefficients.

6. The method of claim 5, wherein:

the ANC system of the headphone earpiece further comprises a feedforward ANC filter subsystem that generates a wide-band (WB) contribution to the anti-noise signal by transforming the reference noise signal based on a set of WB filter coefficients; and each kth MPED filter model further comprises a kth feedforward ANC filter model defining a kth set of values for configuring the set of WB filter coefficients.

7. The method of claim 1, further comprising:

computing a present residual error ratio based on a ratio of a present candidate residual noise to a present estimated actual noise signal, the present candidate residual noise and the present estimated actual noise signal being associated with the present ANC filter configuration, wherein the selecting the one of the pre-trained ANC models as yielding the lowest kth candidate residual noise comprises, for each kth pre-trained ANC model, computing a kth residual error ratio based on a ratio of the kth candidate residual noise to the kth estimated actual noise signal, and selecting the one of the pre-trained ANC models as yielding the lowest residual error ratio, and wherein the directing the ANC system of the headphone earpiece to replace the present ANC filter configuration with a new ANC filter configuration based on the selected one of the pre-trained ANC models is performed responsive to detecting that the lowest residual error ratio is less than the present residual error ratio.

8. The method of claim 7, wherein:

wherein the directing the ANC system of the headphone earpiece to replace the present ANC filter configuration with a new ANC filter configuration based on the selected one of the pre-trained ANC models is performed responsive to detecting that the lowest residual error ratio is less than the present residual error ratio by at least a predetermined threshold amount.

9. The method of claim 1, wherein the directing the ANC system of the headphone earpiece to replace the present ANC filter configuration with the new ANC filter configuration based on the selected one of the pre-trained ANC models comprises:

freezing adaptation of the ANC system for a predetermined release time;

prior to elapsing of the release time, releasing present filter coefficients defined by the present ANC filter configuration; and upon elapsing of the release time, writing new filter coefficients to the ANC system as defined by the new ANC filter configuration, and gradually unfreezing adaptation by the ANC system according to the new ANC filter configuration over a predetermined smoothing time.

10. The method of claim 9, wherein the gradually unfreezing adaptation comprises one of:

gradually increasing an ANC input signal level to a normal level within the smoothing time, the normal level being the ANC input signal level prior to the freezing; or gradually scaling from released filter coefficient values to values defined by the new filter coefficients over the smoothing time.

11. The method of claim 9, wherein the releasing the present filter coefficients comprises:

determining whether there is a divergence condition by determining whether both the residual noise signal presently exceeds a predetermined error threshold level, and a leakage indicator presently exceeds a predetermined leakage threshold level, the leakage indicator being a ratio between the residual noise signal and the reference noise signal;

if there is a divergence condition, replacing old poles/zeros defined by the present ANC filter configuration with all zeros; and if there is no divergence condition, for each of the old poles/zeros:

replacing the old pole/zero with a corresponding one of new poles/zeros defined by the new ANC filter configuration if the old pole/zero is within a predetermined threshold distance of the corresponding one of the new poles/zeros; and replacing the old pole/zero with a zero if the old pole/zero is not within the predetermined threshold distance of the corresponding one of the new poles/zeros.

12. The method of claim 1, wherein the residual noise signal is received by an error microphone disposed at an in-facing side of the headphone earpiece, or by a reference microphone disposed at an out-facing side of the headphone earpiece.

13. The method of claim 1, wherein K is at least 50.

14. An ear cavity frequency response (EFCR) adaptive noise cancelation (ANC) system with path-compensation over an entire main path to the eardrum (MPED) for integration in a headphone earpiece, the ECFR-adaptive ANC system comprising:

an ANC filter system to output an anti-noise signal at a target location based on a present ANC filter configuration so that the anti-noise signal as output at the target location is an estimate of an inverse of an in-ear noise signal, the in-ear noise signal corresponding to ambient noise as manifest at the target location due to acoustical path effects of the MPED while a user is wearing the headphone earpiece in a present wearer/wearing condition relative to an outer ear of the user, the target location being at an in-facing side of the headphone earpiece;

an error microphone to record a residual noise signal representing a combination of the anti-noise signal and the in-ear noise signal in the present wearer/wearing condition;

a model data memory having, stored thereon, K pre-trained ANC models, each kth pre-trained ANC model having a kth anti-noise path (ANP) filter model and a kth MPED filter model previously trained on a kth trained wearer/wearing condition, K being a positive integer greater than one;

a user adaptation engine coupled with the ANC filter system, the error microphone, and the model data memory to:

compute, for each kth pre-trained ANC model, a kth estimated actual noise signal by using the kth ANP filter model to transform the anti-noise signal into a path-compensated anti-noise signal, and removing the path-compensated anti-noise signal from the residual noise signal;

compute, for each kth pre-trained ANC model, a kth estimated eardrum noise signal by using the kth MPED filter model to transform the reference noise signal;

compute, for each kth pre-trained ANC model, a kth candidate residual noise between the kth estimated actual noise signal and the kth estimated eardrum noise signal;

select one of the pre-trained ANC models as yielding the lowest kth candidate residual noise; and direct the ANC filter system to replace the present ANC filter configuration with a new ANC filter configuration based on the selected one of the pre-trained ANC models.

15. The ECFR-adaptive ANC system of claim 14, further comprising:

a reference microphone disposed at an out-facing side of the headphone earpiece and configured to measure the reference noise signal.

16. The ECFR-adaptive ANC system of claim 14, wherein:

the ANC filter system operates at a first sampling rate;

the user adaptation engine further comprises a downsampler to:

downsample the reference noise signal from the first sampling rate to a second sampling rate that is less than five percent of the first sampling rate to generate a downsampled reference noise signal;

downsample the anti-noise signal from the first sampling rate to the second sampling rate to generate a downsampled anti-noise signal; and downsample the residual noise signal from the first sampling rate to the second sampling rate to generate a downsampled residual noise signal;

each kth ANP filter model and each kth MPED filter model runs at the second sampling rate;

the user adaptation engine is to compute the kth estimated actual noise signal by using the kth ANP filter model to transform the downsampled anti-noise signal into the path-compensated anti-noise signal, and by removing the path-compensated anti-noise signal from the downsampled residual noise signal; and the user adaptation engine is to compute the kth estimated eardrum noise signal using the kth MPED filter model to transform the downsampled reference noise signal.

17. The ECFR-adaptive ANC system of claim 14, wherein:

the ANC filter system comprises a feedback ANC filter subsystem that generates a narrow-band (NB) contribution to the anti-noise signal by transforming a feedback reference signal based on a set of NB filter coefficients; and each kth MPED filter model comprises a kth feedback ANC filter model defining a kth set of values for configuring the set of NB filter coefficients.

18. The ECFR-adaptive ANC system of claim 17, wherein:

the ANC system of the headphone earpiece further comprises a feedforward ANC filter subsystem that generates a wide-band (WB) contribution to the anti-noise signal by transforming the reference noise signal based on a set of WB filter coefficients; and each kth MPED filter model further comprises a kth feedforward ANC filter model defining a kth set of values for configuring the set of WB filter coefficients.

19. The ECFR-adaptive ANC system of claim 14, wherein:

the user adaptation engine is further to compute a present residual error ratio based on a ratio of a present candidate residual noise to a present estimated actual noise signal, the present candidate residual noise and the present estimated actual noise signal being associated with the present ANC filter configuration;

the user adaptation engine is to select the one of the pre-trained ANC models as yielding the lowest kth candidate residual noise by, for each kth pre-trained ANC model, computing a kth residual error ratio based on a ratio of the kth candidate residual noise to the kth estimated actual noise signal, and selecting the one of the pre-trained ANC models as yielding the lowest residual error ratio; and the user adaptation engine is to direct the ANC filter system to replace the present ANC filter configuration with the new ANC filter configuration based on the selected one of the pre-trained ANC models responsive to detecting that the lowest residual error ratio is less than the present residual error ratio.

20. The ECFR-adaptive ANC system of claim 19, wherein:

the user adaptation engine is to direct the ANC filter system to replace the present ANC filter configuration with a new ANC filter configuration based on the selected one of the pre-trained ANC models is performed responsive to detecting that the lowest residual error ratio is less than the present residual error ratio by at least a predetermined threshold amount.

* * * * *